US008192305B2

(12) United States Patent
Nishino

(10) Patent No.: US 8,192,305 B2
(45) Date of Patent: Jun. 5, 2012

(54) GOLF CLUB HEAD FOR PUTTER, AND GOLF PUTTER

(75) Inventor: Takumi Nishino, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 437 days.

(21) Appl. No.: 11/652,063

(22) Filed: Jan. 11, 2007

(65) Prior Publication Data

US 2007/0191137 A1 Aug. 16, 2007

(30) Foreign Application Priority Data

Feb. 16, 2006 (JP) ..... 2006-038854

(51) Int. Cl.
*A63B 53/00* (2006.01)

(52) U.S. Cl. ..... 473/349

(58) Field of Classification Search ..... 473/340, 473/349

See application file for complete search history.

(56) References Cited

U.S. PATENT DOCUMENTS 5,221,087 A * 6/1993 Fenton et al. ..... 473/342
6,422,950 B1 * 7/2002 Whitlam ..... 473/313
2003/0216191 A1 * 11/2003 Wright et al. ..... 473/288
2007/0049401 A1 * 3/2007 Tateno et al. ..... 473/339
2007/0142122 A1 * 6/2007 Bonneau ..... 473/340

FOREIGN PATENT DOCUMENTS

JP 4-111370 U 9/1992
JP 3057456 U 2/1999
JP 2003-275353 A 9/2003
JP 2004-290565 A 10/2004

* cited by examiner

*Primary Examiner* — Raeann Gorden
(74) *Attorney, Agent, or Firm* — Birch, Stewart, Kolasch & Birch, LLP

(57) ABSTRACT

Putter head 2 having a head main body 4 constructed with a metal, and a member having low specific gravity 6 constructed with a material having a specific gravity lower than that of the metal constructing the head main body 4. The member having low specific gravity 6 is provided on the sole surface 16 side of the head main body 4. At least a part of the sole surface 16 is constructed with the member having low specific gravity 6. Preferably, the head main body 4 has a hollow part t. Preferably, the center of gravity g2 of the member having low specific gravity 6 is located to get closer to the face side than the center of gravity g1 of the head does. The golf putter according to the present invention has the putter head 2, a shaft 3, and a grip. The present invention provides a golf club head for a putter and a golf putter which achieve favorable rolling.

6 Claims, 22 Drawing Sheets

GOLF CLUB HEAD FOR PUTTER, AND GOLF PUTTER

This application claims priority on Patent Application No. 2006-38854 filed in JAPAN on Feb. 16, 2006. The entire contents of this Japanese Patent Application are hereby incorporated by reference.

BACKGROUND OF THE INVENTION

1. Field of the Invention

The present invention relates to a golf club head for a putter and a golf putter.

2. Description of the Related Art

Putting is performed aiming at rolling of a golf ball on the surface of earth (principally on the green), and involves characteristics that are different from other shots aiming at flying of the ball.

Although it is difficult to identify visually, behavior of the ball immediately after hitting by a putter differs variously. Undesired behavior of the ball immediately after hitting by the putter may be back spin and bound.

In some cases, back spin may be applied to the ball immediately after hitting by the putter. While the back spin is applied, the ball does not move as it rolls on the surface of earth but moves as it slips. This back spin is ceased after a while due to the frictional force between the surface of earth and the ball. The ball after ceasing of the back spin moves as it rolls with overspin. The back spin reduces the distance of rolling of the ball. Because the back spin is accompanied by slipping, it is probable that trajectory of rolling of the ball is destabilized. Therefore, excessive back spin can be a factor to reduce the probability of getting the ball in the cup.

Also, there may be a case in which the ball hit by the putter gets away from the surface of earth for a moment through jumping, bounding or the like. While the ball is getting away from the surface of earth, the ball is not influenced by the slope of the green. Thus, the putting line in the case in which the ball gets away from the surface of earth is different from the putting line in the case in which the ball does not get away from the surface of earth. In addition, the putting line shall vary depending on the distance of the flight of the ball in the air. The difference in the putting lines may make prediction of the putting line difficult, whereby the probability of getting the ball in the cup can be reduced. The putting line means a trajectory of the ball from the position where the ball is hit to the position where the ball drops in the cup.

Therefore, for improving the probability of getting the ball in the cup, favorable rolling of the hit ball (hereinafter, may be also referred to merely as favorable rolling, or, stability of rolling) would be important. The state of favorable rolling may be a state in which the ball after hitting immediately rolls with overspin without excessive flight in the air. The favorable rolling makes prediction of the putting line easier, and increases the rolling distance. Japanese Registered Utility Model No. 3057456 discloses a golf club head for a putter which can easily apply overspin by having a loft angle generated by inclining in a direction that is reverse to general loft (hereinafter, maybe also referred to as reverse loft angle), and by setting this reverse loft angle to be 0 to 5 degree.

SUMMARY OF THE INVENTION

According to experiments carried out by the present inventor, it was revealed that there may be a case in which over spin cannot be effectively applied even with a golf club head for a putter having the reverse loft angle of 0 to 5 degree. In addition, it was also proven that the ball is pressed against the surface of earth at the moment of hitting due to the reverse loft angle, and the ball is apt to be bound by the resulting rebound.

An object of the present invention is to provide a golf club head for a putter and a golf putter which achieves favorable rolling.

The golf club head for a putter according to the present invention has a head main body constructed with a metal, and a member having low specific gravity constructed with a material having a specific gravity lower than that of the metal constructing the head main body. The member having low specific gravity is provided on the sole surface side of the head main body. In this golf club head for the putter, at least a part of the sole surface is constructed with the member having low specific gravity.

Preferably, the head main body has a hollow part.

Preferably, the center of gravity of the member having low specific gravity is located to get closer to the face side than the center of gravity of the head does.

Provided that a maximum width in the toe-to-heel direction of the head is width W1; and a maximum width in the face-to-back direction of the head is width W2, a ratio (W1/W2) of the width W1 to the width W2 is preferably 1.05 or greater and 1.50 or less. Preferably, the width W1 is 80 mm or greater and 130 mm or less.

Preferably, in the aforementioned golf club head for the putter, when the head is comparted into two parts of the face side part and the back side part by a plane that passes through the middle position of the width W2 and that is perpendicular to the face-to-back direction, a ratio (M1/M2) of the weight M1 of the face side part to the weight M2 of the back side part is 0.40 or greater and 1.30 or less.

According to the present invention, a golf club head for a putter and a golf putter which achieve favorable rolling can be obtained.

DESCRIPTION OF THE PREFERRED EMBODIMENTS

Hereinafter, the present invention will be explained in detail by way of preferred embodiments with appropriate reference to the accompanying drawings.

Figure 1:
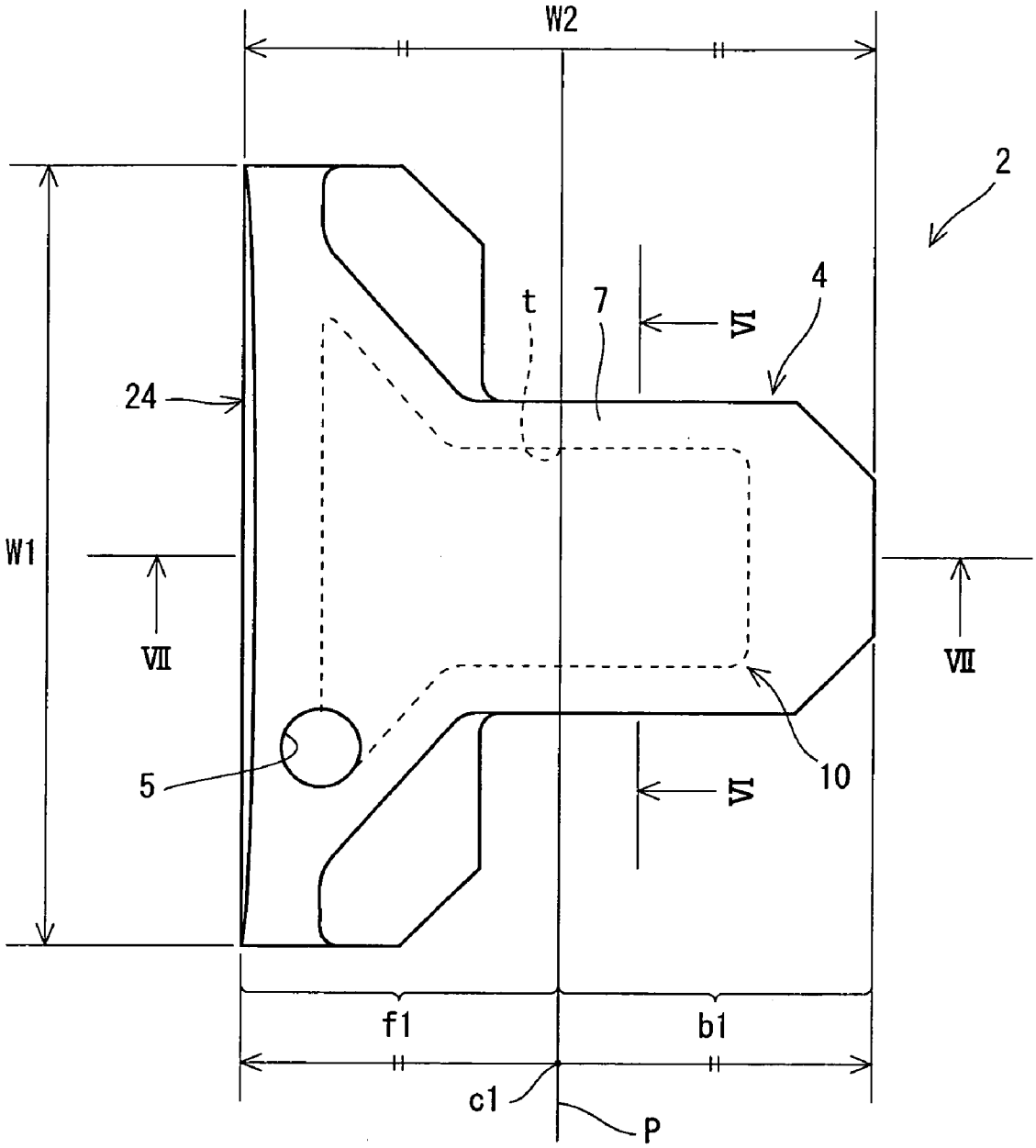
FIG. 1 shows a drawing of a putter head of one embodiment and Example 1 of the present invention viewed from the top surface side.
Figure 2:
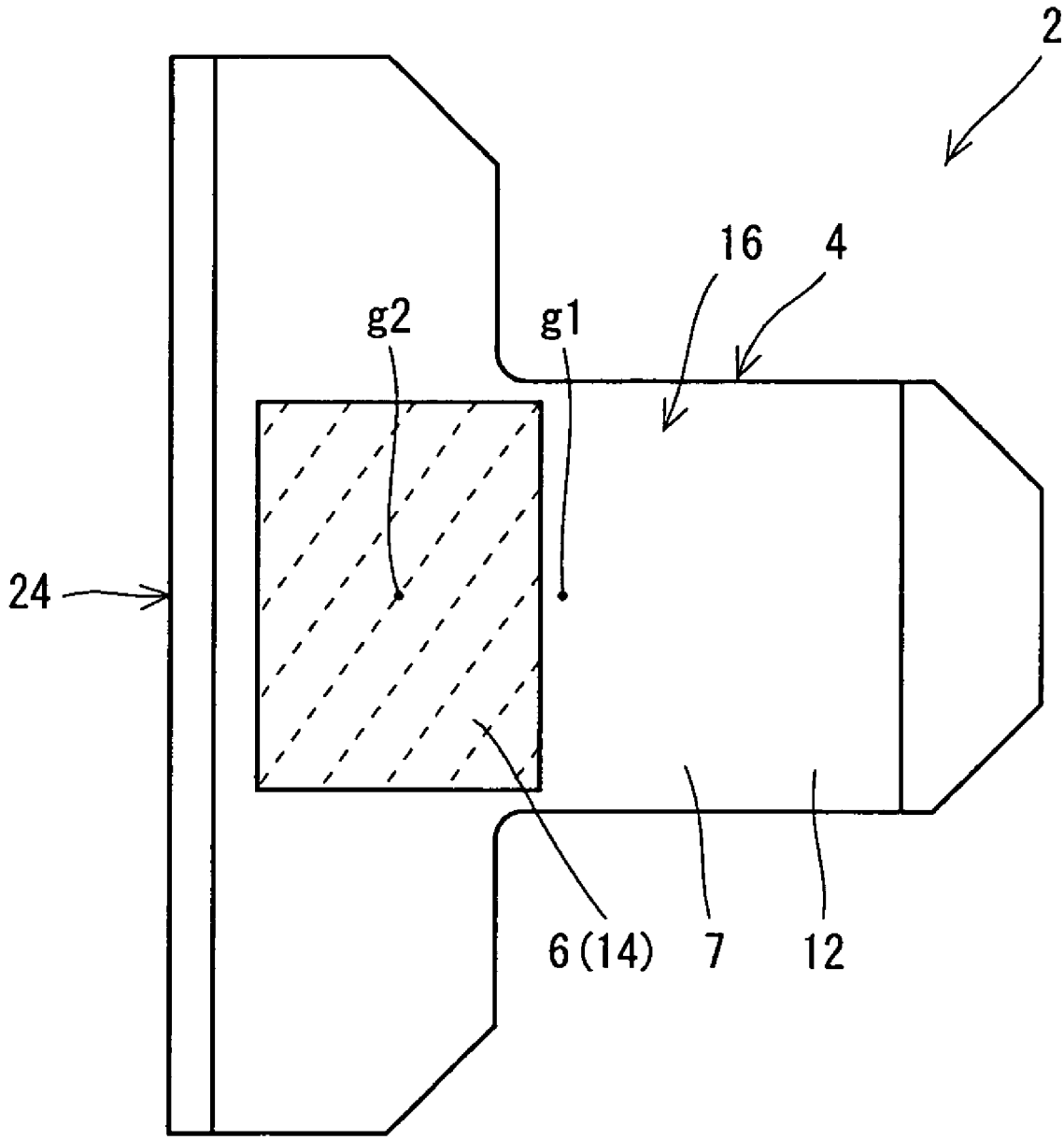
FIG. 2 shows a drawing of the putter head of one embodiment and Example 1 of the present invention viewed from the sole surface side.
Figure 3:
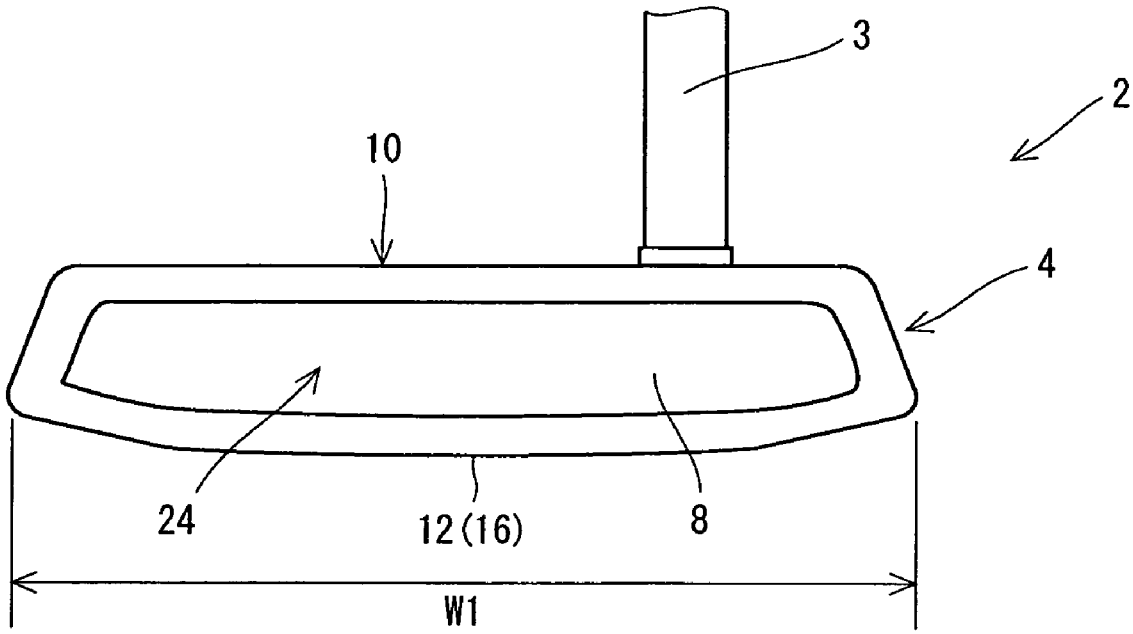
FIG. 3 shows a drawing of the putter head of one embodiment and Example 1 of the present invention viewed from the face surface side.
Figure 4:
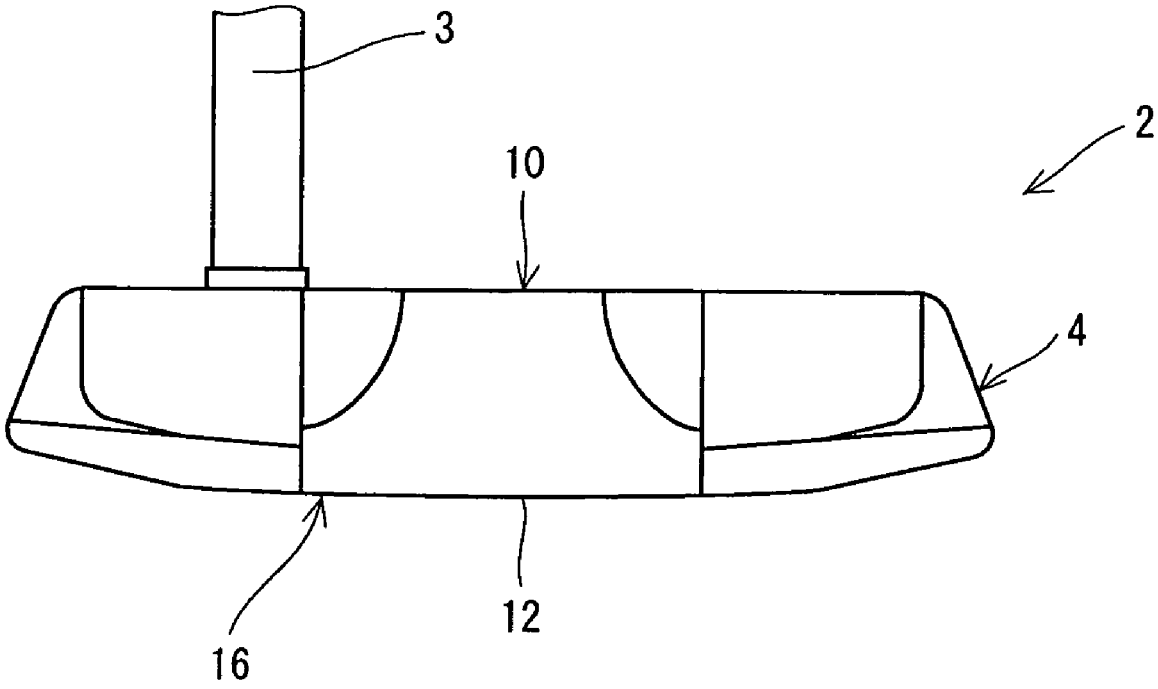
FIG. 4 shows a drawing of the putter head of one embodiment and Example 1 of the present invention viewed from the back side.
Figure 5:
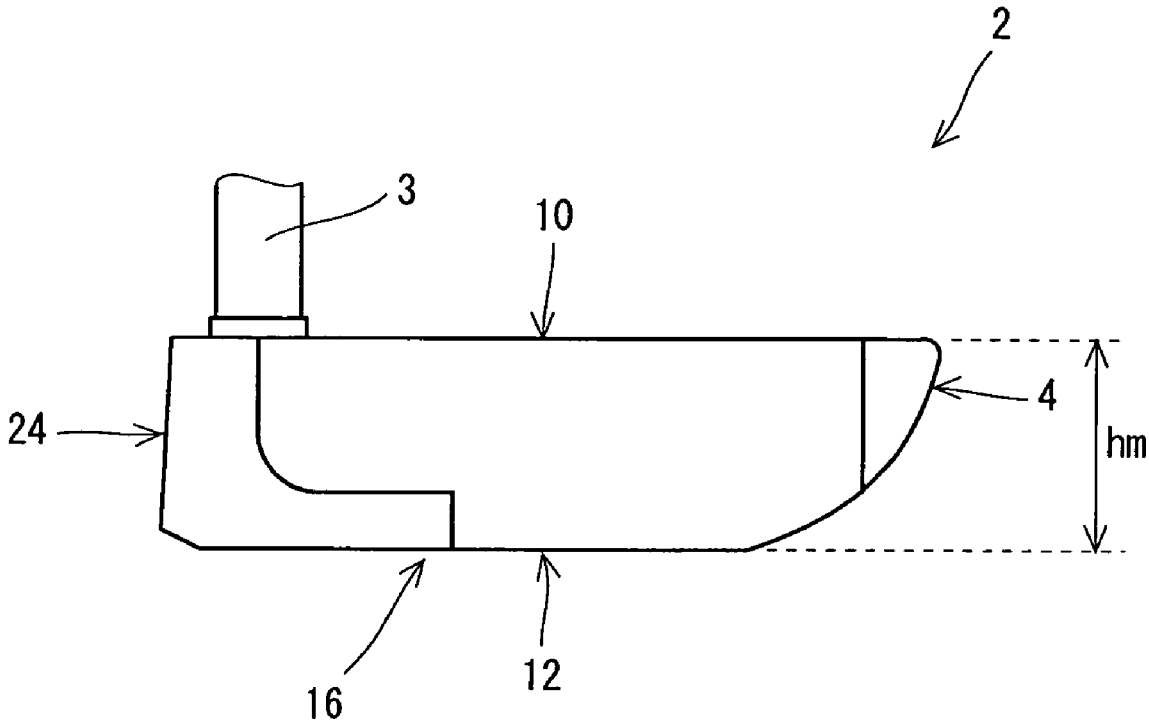
FIG. 5 shows a drawing of the putter head of one embodiment and Example 1 of the present invention viewed from the heel side.
Figure 6:
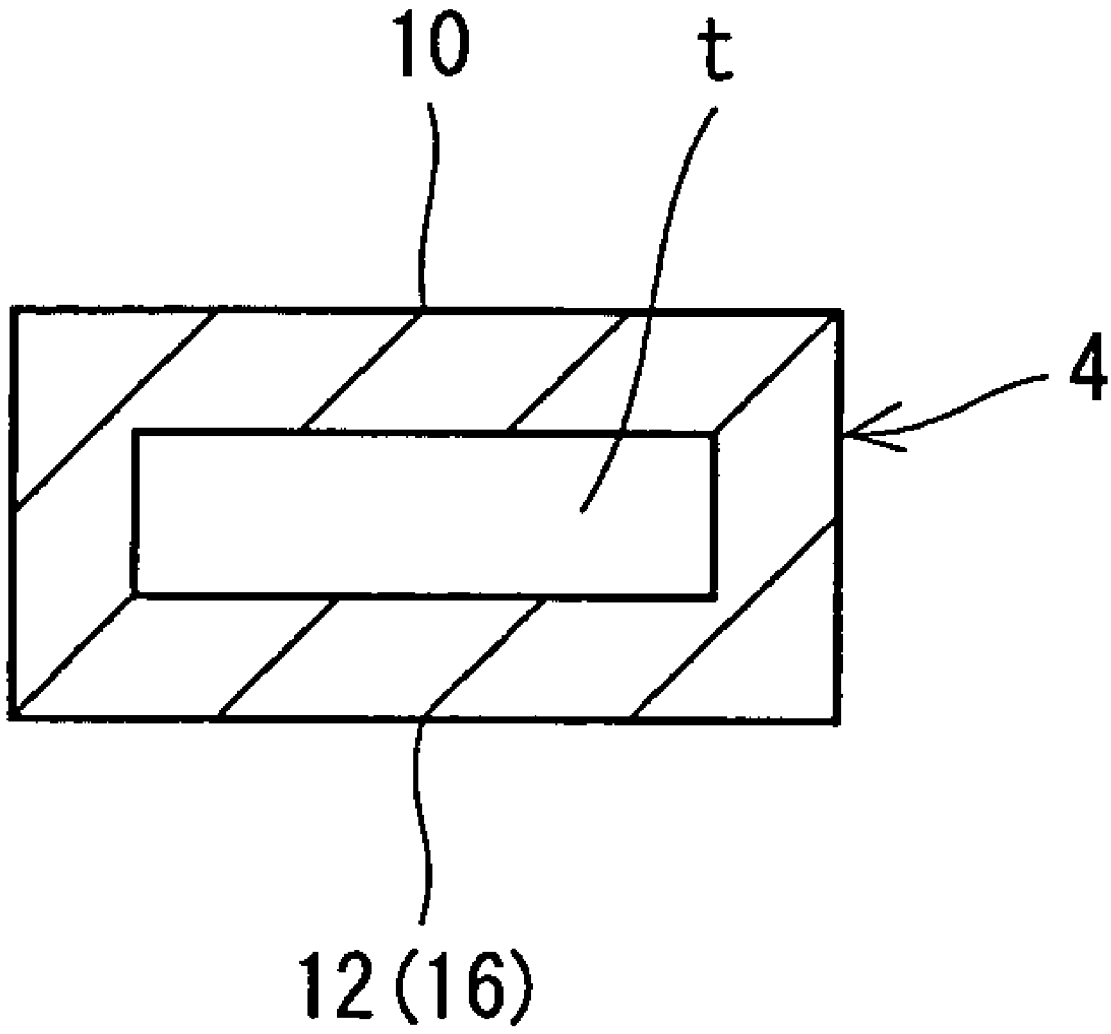
FIG. 6 shows a cross-sectional view taken along the line VI-VI of FIG. 1.
Figure 7:
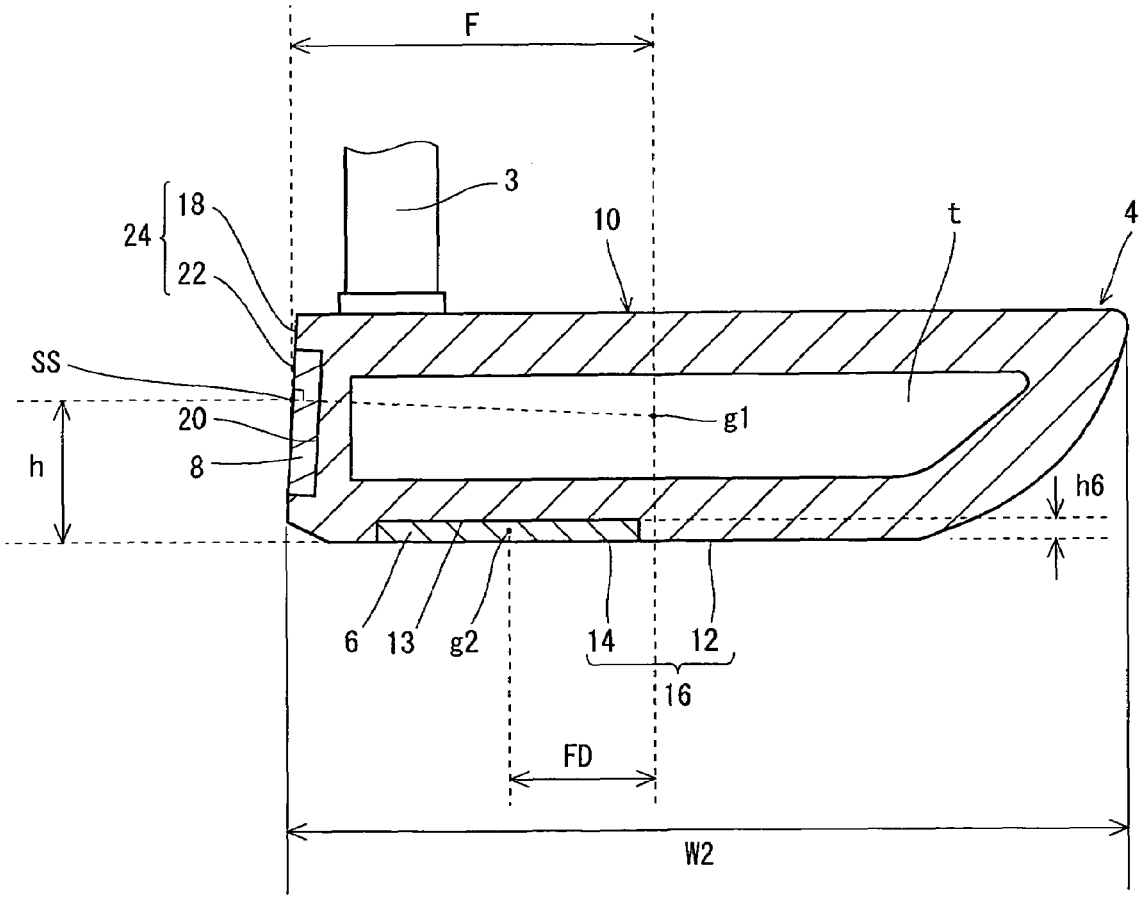
FIG. 7 shows a cross-sectional view taken along the line VII-VII of FIG. 1.

FIG. 1 shows a drawing of the golf club head 2 for a putter according to the present invention (hereinafter, may be also referred to as "putter head") viewed from above (top surface side). FIG. 2 shows a drawing of the putter head 2 viewed from below (sole surface side). FIG. 3 shows a drawing of the putter head 2 viewed from the front (face surface side); FIG. 4 shows a drawing of the putter head 2 viewed from behind (back side); and FIG. 5 shows a drawing of the putter head 2 viewed from the heel side. FIG. 6 shows a cross-sectional view taken along the line VI-VI of FIG. 1; and FIG. 7 shows a cross-sectional view taken along the line VII-VII of FIG. 1. In FIG. 3, FIG. 4, FIG. 5 and FIG. 7, a tip portion of a shaft 3 attached to the putter head 2 is also shown. A golf putter is obtained by attaching the shaft 3 and a grip (not shown in the Figure) to the putter head 2. Although not shown in the Figure, the shaft 3 is bent at around the tip part. Owing to this bending, the lie angle and the real loft angle of the golf putter can be adjusted.

The putter head 2 has a head main body 4, a member having low specific gravity 6, and a face member 8. The member having low specific gravity 6 is provided on the sole surface side of the head main body 4 (see, FIG. 2). The member having low specific gravity 6 is exposed to the sole surface side of the putter head 2. The member having low specific gravity 6 is shown by hatching with broken lines in FIG. 2. The face member 8 constructs a part of the face surface of the putter head 2 (see, FIG. 3). The head main body 4 forms a substantially T-shape in its entirety (see, FIG. 1). Also, the putter head 2 has a shaft hole 5 for insetting and adhering the shaft 3. This putter head 2 does not have a hosel part (neck part) that protrudes upward, however, a mode having the hosel part is also acceptable.

The head main body 4 has a backward-extension 7 which extends from the face side to the back side (see, FIG. 1). The backward-extension 7 extends substantially parallel to the face-to-back direction. The backward-extension 7 extends substantially perpendicularly to the toe-to-heel direction. This backward-extension 7 can be of assistance to take back easily. The backward-extension 7 makes it easy to take back straight along the intended direction.

The putter head 2 has a hollow part t (see, FIG. 1, FIG. 6 and FIG. 7). The hollow part t is provided on the head main body 4. What is indicated by the broken line in FIG. 1 is a contour line of the hollow part t. The hollow part t cannot be visually recognized from outside.

The hollow part t may not be provided inside of the head main body 4. For example, the hollow part t may be also formed by providing a recessed part, which is open to the sole side, at the head main body 4, and sealing the opening of this recessed part with the member having low specific gravity 6. Also, the hollow part t may be provided inside of the member having low specific gravity 6. Preferably, the hollow part t is provided inside of the head main body 4. By providing the head main body 4 with the hollow part t, it becomes easy to increase the volume of the hollow part t.

The head main body 4 has a top surface (may be also referred to as "crown surface") 10. Furthermore, as shown in FIG. 7, the head main body 4 has a sole surface part 12 and a sole recessed part 13. The sole recessed part 13 is positioned below the hollow part t. The member having low specific gravity 6 is provided in the sole recessed part 13. The member having low specific gravity 6 is a flat plate-shaped member. The member having low specific gravity 6 fills in the sole recessed part 13. The external surface 14 of the member having low specific gravity 6 and the sole surface part 12 of the head main body 4 are substantially flush (see, FIG. 7). The external surface 14 of the member having low specific gravity 6 is smoothly continuous with the sole surface part 12. The sole surface 16 of the putter head 2 is constructed with the sole surface part 12, and the external surface 14 of the member having low specific gravity 6. The sole surface 16 does not have any recessed part. The sole surface 16 is entirely constructed with a smoothly curved face or a plane. The member having low specific gravity 6 constructs a part of the sole surface 16.

As shown in FIG. 7, the head main body 4 has a face surface part 18 and a face recessed part 20. The face member 8 is provided in the face recessed part 20. The face member 8 is a flat plate-shaped member. The face member 8 fills in the face recessed part 20. The external surface 22 of the face member 8 and the face surface part 18 of the head main body 4 are substantially flush (see, FIG. 7). In other words, the external surface 22 of the face member 8 is smoothly continuous with the face surface part 18. The face surface 24 of the putter head 2 is constructed with the external surface 22 of the face member 8, and the face surface part 18. The face surface 24 is a flat surface.

The head main body 4 is constituted of a metal. Illustrative examples of the metal constituting the metal head main body 4 include stainless (specific gravity: 7.8), copper (specific gravity: 8.9), brass (specific gravity: 8.4), soft iron (specific gravity: 7.9), pure titanium (specific gravity: 4.7) and titanium alloys (specific gravity: approximately 4.4 to 4.8). The head main body 4 may be produced by combining multiple materials. The head main body 4 may be produced by combining multiple members. The head main body 4 having the hollow part t can be produced in a similar manner to, for example, hollow heads for wood-type golf clubs, and the like.

The material of the member having low specific gravity 6 is not limited. Illustrative examples of the material of the member having low specific gravity 6 include FRP (fiber reinforced plastics), magnesium alloys (specific gravity: 1.8), aluminum (specific gravity: 2.7), aluminum alloys (specific gravity: approximately 2.6 to 2.8). Illustrative examples of the FRP (fiber reinforced plastic) include CFRP (carbon fiber reinforced plastics; specific gravity: 1.6), GFRP (glass fiber reinforced plastics; specific gravity: 1.8), and the like. In light of decrease in the specific gravity to be lower than the head main body 4, the metal used in the member having low specific gravity 6 is preferably a light metal. The member having low specific gravity 6 may be produced by combining multiple materials. The member having low specific gravity 6 may be produced by combining multiple members.

As the material of the member having low specific gravity 6, the FRP (fiber reinforced plastic) is more preferable than a metal (light metal). By using the FRP (fiber reinforced plastic) in the member having low specific gravity 6, rigidity equivalent to or greater than a metal can be secured. Moreover, by using the FRP (fiber reinforced plastic) in the member having low specific gravity 6, impact upon hitting the ball can be relaxed owing to an effect of energy loss of the matrix resin of the FRP (fiber reinforced plastic), thereby improving feel at impact.

The member having low specific gravity 6 is fixed to the head main body 4 by a means such as welding, fitting, press-fitting, or adhesion by an adhesive. Possible fixing means may be selected depending on the materials of the member having low specific gravity 6 and the head main body 4.

As the face member 8, a resin, an elastomer, a rubber or the like may be used. The face member 8 constructed with such a comparatively soft material improves the feel at impact. The face member 8 accounts for the vast majority of the face surface 24 of the putter head 2.

The hollow part t enables the size of the putter head 2 to be large. By providing the hollow part t, moment of inertia of the head can be increased under a restriction from the head weight. The hollow part t can be responsible for degree of freedom of the shape of the head. The hollow part t can be responsible for improvement of the design freedom of the position of the center of gravity g1 of the head.

The center of gravity g2 of the member having low specific gravity 6 is located to get closer to the face side than the center of gravity g1 of the head does (see, FIG. 2). In other words, the center of gravity g2 of the member having low specific gravity 6 is to get closer to the face surface 24 than the center of gravity g1 of the head does. The center of gravity g1 of the head is the center of gravity of the putter head 2. As compared with the case in which the center of gravity g2 of the member having low specific gravity 6 is located to get closer to the back side than the center of gravity g1 of the head does, depth F of the center of gravity of the center of gravity g1 of the head is likely to be great when the center of gravity g2 is positioned to get closer to the face side than the center of gravity g1 of the head does.

What is indicated by W1 in FIG. 1 and the like is the maximum width in the toe-to-heel direction of the putter head 2. What is indicated by W2 in FIG. 1 and the like is the maximum width in the face-to-back direction of the putter head 2. In the putter head 2, the ratio (W1/W2) of the width W1 to the width W2 is 1.05 or greater and 1.50 or less.

As shown in FIG. 1, the case in which the putter head 2 is comparted into two parts of the face side part f1 and the back side part b1 by a plane P that passes through the middle position c1 of the width W2 and that is perpendicular to the face-to-back direction is supposed. The weight of the face side part f1 is defined as M1, and the weight of the back side part b1 is defined as M2. In the putter head 2, the ratio (M1/M2) of the weight M1 to the weight M2 is 0.40 or greater and 1.30 or less. The weight (M1+M2) derived by adding the weight M1 to the weight M2 is a total weight of the head.

In light of improvement of a sense of relief at address while securing an appropriate face width, the maximum width W1 in the toe-to-heel direction is preferably equal to or greater than 80 mm, more preferably equal to or greater than 85 mm, and particularly preferably equal to or greater than 90 mm. In light of minimizing the difficulty in setting at address with an excessively large head in the toe-to-heel direction, the maximum width W1 in the toe-to-heel direction is preferably equal to or less than 130 mm, more preferably equal to or less than 120 mm, and particularly preferably equal to or less than 110 mm.

In light of inhibition of variations of directionality upon mishitting by increasing the depth of the center of gravity, and in light of improvement of the stability of the stroke, the maximum width W2 in the face-to-back direction is preferably equal to or greater than 50 mm, more preferably equal to or greater than 60 mm, and particularly preferably equal to or greater than 70 mm. When the depth of the center of gravity is too great, the loft angle upon impact (loft angle of the face surface 24 with respect to the vertical direction upon impact) becomes too great, as the case may be, owing to the centrifugal force that acts on the head upon stroke. When the loft angle upon impact becomes too great, the ball immediately after hitting may excessively jumps, and thus inferior rolling may be achieved. In this respect, the maximum width W2 in the face-to-back direction is preferably equal to or less than 120 mm, more preferably equal to or less than 110 mm, and particularly preferably equal to or less than 100 mm.

In light of prevention of the depth of the center of gravity from becoming too great, and in light of minimizing the difficulty in setting due to the head shape, the ratio (W1/W2) is preferably equal to or greater than 1.05, more preferably equal to or greater than 1.15, and particularly preferably equal to or greater than 1.25. In light of prevention of the depth of the center of gravity from becoming too small, the ratio (W1/W2) is preferably equal to or less than 1.50, more preferably equal to or less than 1.45, and particularly preferably equal to or less than 1.40.

By setting the ratio (W1/W2) to be 1.05 or greater and 1.50 or less, the width W1 to be 80 mm or greater and 130 mm or less, and the ratio (M1/M2) to be 0.40 or greater and 1.30 or less, the face width and head size suited for putting, the depth of the center of gravity suited as a putter head, and adequate moment of inertia can be concomitantly achieved. The head size referred to herein means the size of the head visually recognized at address.

In light of prevention of the depth of the center of gravity from becoming too great, thereby suppressing excessive jumping of the ball immediately after hitting, the weight M1 of the face side part f1 is preferably equal to or greater than 100 g, more preferably equal to or greater than 110 g, and particularly preferably equal to or greater than 120 g. In light of prevention of the depth of the center of gravity from becoming too small, thereby inhibiting the variations of directionality upon mishitting, the weight M1 of the face side part f1 is preferably equal to or less than 200 g, more preferably equal to or less than 190 g, and particularly preferably equal to or less than 180 g.

In light of prevention of the depth of the center of gravity from becoming too small, thereby inhibiting the variations of directionality upon mishitting, the weight M2 of the back side part b1 is preferably equal to or greater than 150 g, more preferably equal to or greater than 160 g, and particularly preferably equal to or greater than 170 g. In light of prevention of the depth of the center of gravity from becoming too great, thereby suppressing excessive jumping of the ball immediately after hitting, the weight M2 of the back side part b1 is preferably equal to or less than 250 g, more preferably equal to or less than 240 g, and particularly preferably equal to or less than 230 g.

In light of prevention of the depth of the center of gravity from becoming too great, thereby suppressing excessive jumping of the ball immediately after hitting, the ratio (M1/M2) is preferably equal to or greater than 0.40, more preferably equal to or greater than 0.50, and particularly preferably equal to or greater than 0.60. In light of prevention of the depth of the center of gravity from becoming too small, thereby inhibiting the variations of directionality upon mishitting, the ratio (M1/M2) is preferably equal to or less than 1.30, more preferably equal to or less than 1.20, and particularly preferably equal to or less than 1.10.

Upon putting, there may be a case in which the impact is caused in a state with one's hands ahead of the ball. At impact in the state with one's hands ahead of the ball, the loft angle upon impact becomes smaller than the real loft angle. When the real loft angle is small, the loft angle upon impact may be a value of minus. In other words, the state of reverse loft as described above may be generated. In this instance, the ball is pressed against the surface of earth at the impact of the ball, and the ball is apt to be bound. In light of prevention of the loft angle upon impact from becoming the value of minus, the real loft angle is preferably equal to or greater than 1.0 degree, more preferably equal to or greater than 1.5 degree, and particularly preferably equal to or greater than 2.0 degree.

In light of suppression of excessive jumping of the ball immediately after hitting, the real loft angle is preferably equal to or less than 6.0 degree, more preferably equal to or less than 5.5 degree, and particularly preferably equal to or less than 5.0 degree.

In light of prevention of the club from loss of the balance to result in too light feeling, thereby stabilizing the swing, total head weight is preferably equal to or greater than 300 g, more preferably equal to or greater than 315 g, and particularly preferably equal to or greater than 330 g. In light of prevention of the club from loss of the balance to result in too heavy feeling, thereby facilitating swinging, the total head weight is preferably equal to or less than 400 g, more preferably equal to or less than 385 g, and particularly preferably equal to or less than 370 g.

In light of improvement of the stability of the head in stroke, thereby improving the directionality of the hit ball, the left-to-right moment of inertia of the head is preferably equal to or greater than 3000 ($g \cdot cm^2$), more preferably equal to or greater than 3500 ($g \cdot cm^2$), and particularly preferably equal to or greater than 4000 ($g \cdot cm^2$). When taken into consideration of the preferred range of the total head weight, the left-to-right moment of inertia of the head is usually equal to or less than 6000 ($g \cdot cm^2$).

In light of prevention of the size of the head from becoming too large, thereby obtaining a readily settable putter head in the range of preferable total head weight, the head main body has a specific gravity S1 of preferably equal to or greater than 3.0, more preferably equal to or greater than 4.0, and particularly preferably equal to or greater than 4.5. In light of inhibition of difficulty in setting which results from too small head size, and in light of improvement of degree of freedom of the head shape by increasing the head volume, the head main body has a specific gravity S1 of preferably equal to or less than 10.0, more preferably equal to or less than 9.0, and particularly preferably equal to or less than 8.5.

In light of improvement of the durability and strength of the member having low specific gravity, the member having low specific gravity has a specific gravity S2 of preferably equal to or greater than 0.5, more preferably equal to or greater than 0.7, and particularly preferably equal to or greater than 0.9. In light of weight saving in the vicinity of the sole part, and in light of increase in the height of the sweet spot, the member having low specific gravity has a specific gravity S2 of equal to or less than 7.0, more preferably equal to or less than 6.0, and particularly preferably equal to or less than 5.0.

In light of weight saving in the vicinity of the sole part, the ratio (S1/S2) of the specific gravity S1 to the specific gravity S2 is greater than 1.0. In light of weight saving in the vicinity of the sole part, the ratio (S1/S2) is preferably equal to or greater than 1.5, and more preferably equal to or greater than 2.0. When the ratio (S1/S2) is too great, the specific gravity S1 of the head main body may be too great, or the specific gravity S2 of the member having low specific gravity may be too small. In light of allowing the absolute value of the specific gravity S1 of the head main body and the absolute value of the specific gravity S2 of the member having low specific gravity to fall within the preferable range as described above, the ratio (S1/S2) is preferably equal to or less than 20.0, more preferably equal to or less than 15.0, and particularly preferably equal to or less than 10.0.

When the sweet spot height h is too small, the position of the impact point of the ball is apt to be upper than the sweet spot SS. When the position of the impact point of the ball is upper than the sweet spot SS, there may be a case in which the head is rotated by the impact shock upon hitting, and this rotation may increase the loft angle upon impact. By this increase in the loft angle, the ball becomes apt to jump up immediately after the impact. This jumping of the ball may deteriorate the favorable rolling. In this respect, the sweet spot height h is preferably equal to or greater than 10.0 mm, more preferably equal to or greater than 11.0 mm, and particularly preferably equal to or greater than 12.0 mm. When the sweet spot height h is too great, a distance from the position of the impact point of the ball to the sweet spot SS is excessively increased, and the resilience performance may be deteriorated. In this respect, the sweet spot height h is preferably equal to or less than 16.0 mm, more preferably equal to or less than 15.5 mm, and particularly preferably equal to or less than 15.0 mm.

Commercially available golf ball has a diameter of generally about 42.7 mm. Therefore, when the ball is placed on the surface of earth, the height Hc of the center position of the ball from the surface of earth is approximately 21.3 mm to 21.4 mm. This height Hc is equal to the radius of the golf ball. On the other hand, at the moment of the impact, a given gap distance T (mm) is present between the putter head and the surface of earth. Provided that the center point between the face surface and the position to be brought into contact with the ball upon hitting is defined as an impact point, the height of the impact point on the face surface shall be (Hc−T). The present inventor allowed eleven testers to perform putting each 30 balls. Thus, a datum of the mean value obtained by accumulating data of impact points of 330 balls in total was obtained. According to this datum, it was reveled that the height of the impact point on the face surface (height from the sole surface to the impact point) was about 13 mm. In determination of the preferred range of the sweet spot height h described above, the gap distance T upon hitting of the ball by golf players in effect is considered. When the sweet spot height h falls within the aforementioned preferable range, the impact point is likely to locate on the underside of the sweet spot SS, and the impact point is not positioned too far away from the sweet spot SS.

In some putter heads, the sweet spot height h may be too small. In particular, the sweet spot height h of the putter heads without having any hosel part (neck part) that protrudes upward as in the putter head 2, and the putter heads having the sole provided with a heavy load is liable to be too small. Such too small sweet spot height h increases probability of hitting of the ball at a position that is higher than the sweet spot SS. When the position of the impact point is higher than the sweet spot SS, jumping up of the ball immediately after the impact is apt to be increased. In the putter head 2, the member having low specific gravity 6 provided on the sole surface side of the head main body 4 elevates the position of the center of gravity g1 of the head. As compared with the case in which the member having low specific gravity 6 is not provided, in other words, the case in which the member having low specific gravity 6 is replaced with the same material as that of the head main body 4, the position of the center of gravity g1 of the head of the putter head 2 shall be high.

The present invention is particularly advantageous for the heads having too low position of the center of gravity of the head in the state without having the member having low specific gravity. In light of improvement of efficacy of the aforementioned effect to elevate the position of the center of gravity of the head, maximum head height hm of the putter head (see, FIG. 5) is preferably equal to or less than 40 mm, more preferably equal to or less than 35 mm, and particularly preferably equal to or less than 30 mm. In light of securement of the face height that is appropriate for hitting the ball, the maximum head height hm of the putter head is preferably equal to or greater than 15 mm, more preferably equal to or greater than 18 mm, and particularly preferably equal to or greater than 20 mm.

In light of improvement of the effect to elevate the position of the center of gravity of the head, the volume of the member having low specific gravity 6 is preferably equal to or greater than 1.0 $cm^3$, more preferably equal to or greater than 2.0 $cm^3$, and particularly preferably equal to or greater than 3.0 $cm^3$. In light of prevention of the size of the head from becoming excessively large, the volume of the member having low specific gravity 6 is preferably equal to or less than 10.0 $cm^3$, more preferably equal to or less than 8.0 $cm^3$, and particularly preferably equal to or less than 6.0 $cm^3$.

In light of increase in the effect to elevate the position of the center of gravity of the head by flattening of the member having low specific gravity 6, maximum thickness h6 of the member having low specific gravity 6 (see, FIG. 7) is preferably equal to or less than 10 mm, more preferably equal to or less than 7 mm, and particularly preferably equal to or less than 5 mm. In light of securement of the rigidity and strength of the member having low specific gravity 6, the maximum thickness h6 of the member having low specific gravity 6 is preferably equal to or greater than 1 mm, more preferably equal to or greater than 2 mm, and particularly preferably equal to or greater than 3 mm.

In light of improvement of the effect to elevate the position of the center of gravity of the head, ratio (Sp/St) of the surface area Sp of the member having low specific gravity to total area St of the sole surface of the head is preferably equal to or greater than 0.1, more preferably equal to or greater than 0.15, and particularly preferably equal to or greater than 0.2. In light of prevention of the size of the head from becoming excessively large, the ratio (Sp/St) is preferably equal to or less than 0.5, more preferably equal to or less than 0.45, and particularly preferably equal to or less than 0.4.

Also in the case in which a recessed part is provided on the sole surface of the head in place of providing the member having low specific gravity 6, the position of the center of gravity g1 of the head becomes high. However, in this instance, the head becomes unstable at address. In other words, stability of the head at address is deteriorated. In addition, during playing golf, marking of the position of the ball is conducted by a marker when the ball on the green is picked up. In this marking, many golf players push the marker with the sole surface of the putter head. Due to the recessed part provided on the sole surface, pushing of the marker may be difficult. As the recessed part is deeper, pushing of the marker may be further difficult. Owing to the member having low specific gravity of the present invention, the recessed part of the sole surface can be eliminated, or can be lessened.

Also, the height of the center of gravity g1 of the head can be increased by enlarging the area of the top surface 10, or narrowing the area of the sole surface 16, in place of providing the member having low specific gravity 6. However, when the area of the top surface 10 is too large, the head appears to be excessively large at address, whereby a feeling of strangeness may be evoked. Also, when the area of the sole surface 16 is too small, the head may be unstable. In other words, when the area of the sole surface 16 is too small, stability of the head at address is deteriorated. According to the present invention, use of the member having low specific gravity 6 enables the center of gravity g1 of the head to elevate without altering the area of the top surface 10 and the area of the sole surface 16.

Also in the case in which the top surface 10 is provided with a member having high specific gravity in place of providing the sole surface 16 with the member having low specific gravity 6, the height of the center of gravity g1 of the head can be elevated. Because the top surface 10 is a conspicuous face at address, the member having high specific gravity provided on the top surface 10 will be conspicuous at address. Therefore, when the member having high specific gravity is provided on the top surface 10, consideration will be required in aspects of appearance or design. Along with the consideration in aspects of appearance or design, the member of the material having high specific gravity provided on the top surface 10 shall be restricted in terms of the shape. The golf players may feel strangeness resulting from the member having high specific gravity which is conspicuous at address. Contrary to such cases, the member having low specific gravity 6 provided on the sole surface 16 cannot be visually recognized at address. In addition, the top surface 10 is narrower as compared with the sole surface 16 in many cases. Therefore, the design freedom of the member having low specific gravity 6 provided on the sole surface 16 can be increased in comparison with the design freedom of the member having high specific gravity to be provided on the top surface 10. As a matter of course, according to the present invention, the member having low specific gravity 6 provided on the sole surface 16, and the member having high specific gravity provided on the top surface 10 may be used in combination.

In light of suppression of excessive jumping of the ball immediately after hitting, the depth F of the center of gravity is preferably equal to or less than 50.0 mm, more preferably equal to or less than 45.0 mm, and particularly preferably equal to or less than 40.0 mm. In light of inhibition of putting mistake by suppressing unwanted motion (shake) of the head in shots by mistake resulting from hitting of the ball at the toe side or the heel side of the face surface, and in light of improvement of the stability of the head in stroke, the depth F of the center of gravity is preferably equal to or greater than 18.0 mm, more preferably equal to or greater than 20.0 mm, and particularly preferably equal to or greater than 22.0 mm.

According to the foregoing embodiment, the depth F of the center of gravity is increased by disposing the center of gravity g2 of the member having low specific gravity 6 to locate to get closer to the face side than the center of gravity g1 of the head does. In light of improvement of the effect to increase the depth F of the center of gravity, the distance in the face-to-back direction FD between the center of gravity g1 of the head and the center of gravity g2 of the member having low specific gravity 6 (see, FIG. 7) is preferably equal to or greater than 10.0 mm, more preferably equal to or greater than 13.0 mm, and particularly preferably equal to or greater than 16.0 mm. In light of prevention of the depth of the center of gravity from becoming too great, thereby suppressing excessive jumping of the ball immediately after hitting, the distance in the face-to-back direction FD between the center of gravity g1 of the head and the center of gravity g2 of the member having low specific gravity 6 is preferably equal to or less than 30 mm, more preferably equal to or less than 28 mm, and particularly preferably equal to or less than 26 mm.

Each term as used herein can be defined as described below.

Toe-to-Heel Direction

In a reference state in which a head is placed on a reference horizontal plane K1 at a predetermined lie angle and loft angle, a direction that is parallel to the face surface and that is parallel to the reference horizontal plane K1 may be defined as the toe-to-heel direction. When the predetermined lie angle is uncertain, the predetermined lie angle may be 71 degree. The lie angle of 71 degree is an average lie angle of general putter clubs. When the predetermined lie angle and loft angle are uncertain, the aforementioned reference state may be a state in which the head alone is allowed to be placed on the reference horizontal plane K1.

Face-to-Back Direction

In the reference state described above, a direction that is parallel to the reference horizontal plane K1 and that is perpendicular to the toe-to-heel direction may be defined as the face-to-back direction.

Left-to-Right Moment of Inertia of the Head

In the reference state described above, a moment of inertia of the head provided that the axis of rotation is a line that passes the center of gravity g1 of the head and that is perpendicular to the reference horizontal plane may be defined as the left-to-right moment of inertia of the head.

Sweet Spot SS

An intersecting point of a perpendicular line drawn from the center of gravity g1 of the head to the face surface with the face surface may be defined as the sweet spot SS (see, FIG. 7).

Sweet Spot Height h

In the head in the reference state described above, a height of the sweet spot SS from the reference horizontal plane K1 may be defined as the sweet spot height h (see, FIG. 7).

Depth of the Center of Gravity F

In the head in the reference state described above, a distance in the face-to-back direction between the center of gravity g1 of the head and the sweet spot may be defined as the depth F of the center of gravity (see, FIG. 7).

Maximum Head Height hm of the Putter Head

In the head in the reference state described above, maximum height of the head from the reference horizontal plane K1 may be defined as the maximum head height hm of the putter head.

EXAMPLES

Hereinafter, advantages of the present invention will be explained by way of Examples, however, the present invention should not be construed as being limited based on the description of the Examples.

Example 1

A putter head according to Example 1 was similar to the putter head 2 of the aforementioned embodiment shown in FIG. 1 to FIG. 7. Hereinafter, Example 1 will be explained by way of reference numerals used in the foregoing description with respect to the putter head 2. The material of the head main body 4 was SUS630. The head main body 4 having the hollow part t was produced by welding of two cast members. Further, the member having low specific gravity 6 having the shape and thickness substantially the same as the sole recessed part 13 of the head main body 4 was produced. The member having low specific gravity 6 was made of CFRP (carbon fiber reinforced plastic). Specifically, the member having low specific gravity 6 was obtained by stacking multiple pieces of MR350C-125S that is a pre-preg manufactured by Mitsubishi Rayon Co., Ltd., and molding through compression and heating with a mold. Matrix resin of this CFRP (carbon fiber reinforced plastic) was an epoxy resin. Thus resulting member having low specific gravity 6 was adhered to the sole recessed part 13 by an adhesive. As the adhesive, EW2010 manufactured by Sumitomo 3M Ltd. was used. In addition, the face member 8 was adhered to the face recessed part 20 by the adhesive. The face member 8 was obtained by thermal molding of a thermoplastic urethane resin. A golf putter according to Example 1 was obtained by attaching the shaft 3 and a grip to thus resulting putter head 2. For attaining a lie angle and the like suited for a golf putter, the tip part of the shaft 3 was arbitrarily bent.

Example 2

Figure 8:
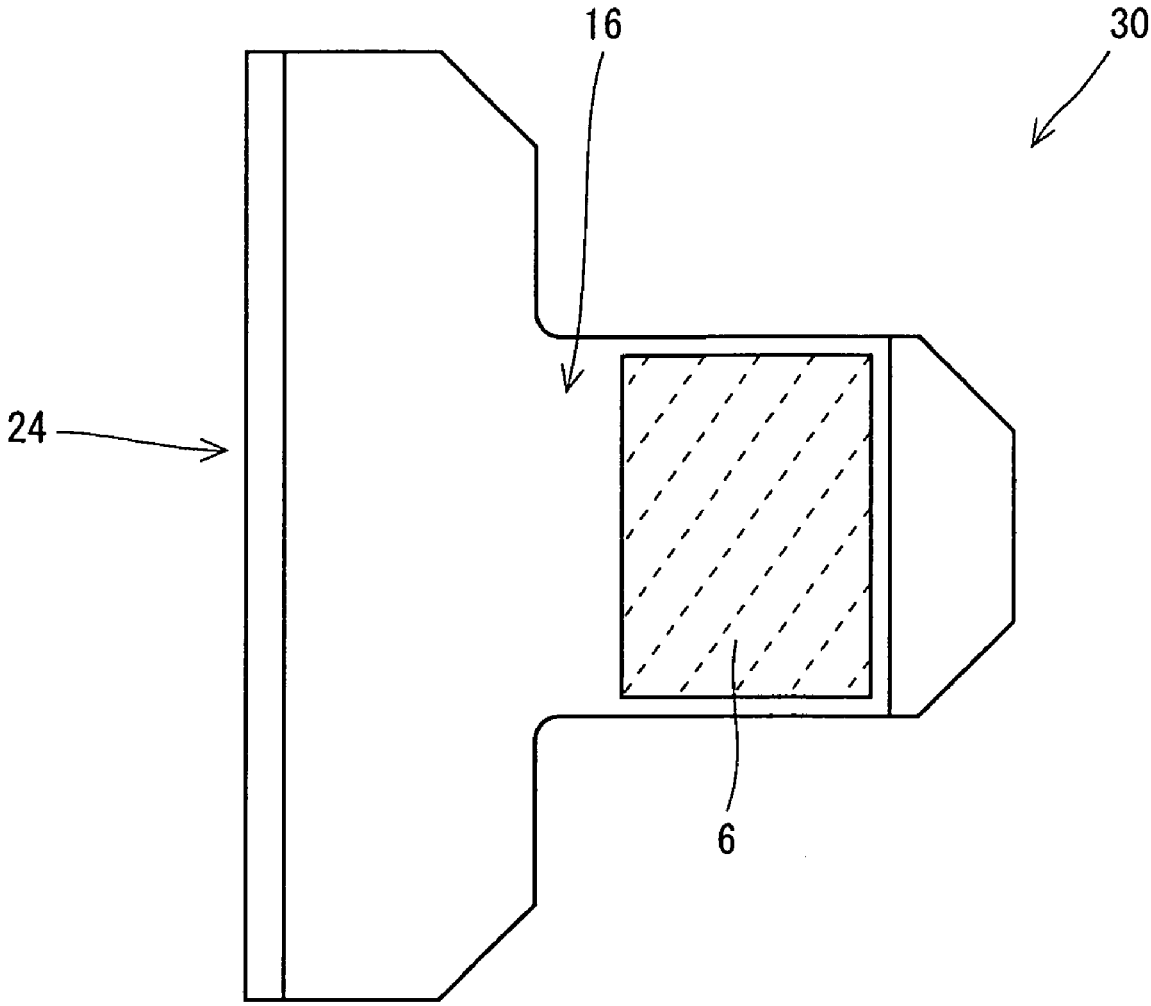
FIG. 8 shows a drawing of a putter head according to Example 2 viewed from the sole surface side.

A putter club according to Example 2 was obtained in a similar manner to Example 1 except that positions of the member having low specific gravity 6 and the sole recessed part 13 were located on further back side than in Example 1. FIG. 8 shows a drawing of a putter head according to Example 2 viewed from the sole surface side. Although not shown in the Figure, position of the center of gravity g2 of the member having low specific gravity 6 in the putter head 30 is located to get closer to the back side than the center of gravity g1 of the head of the putter head 30 does.

Example 3

Figure 9:
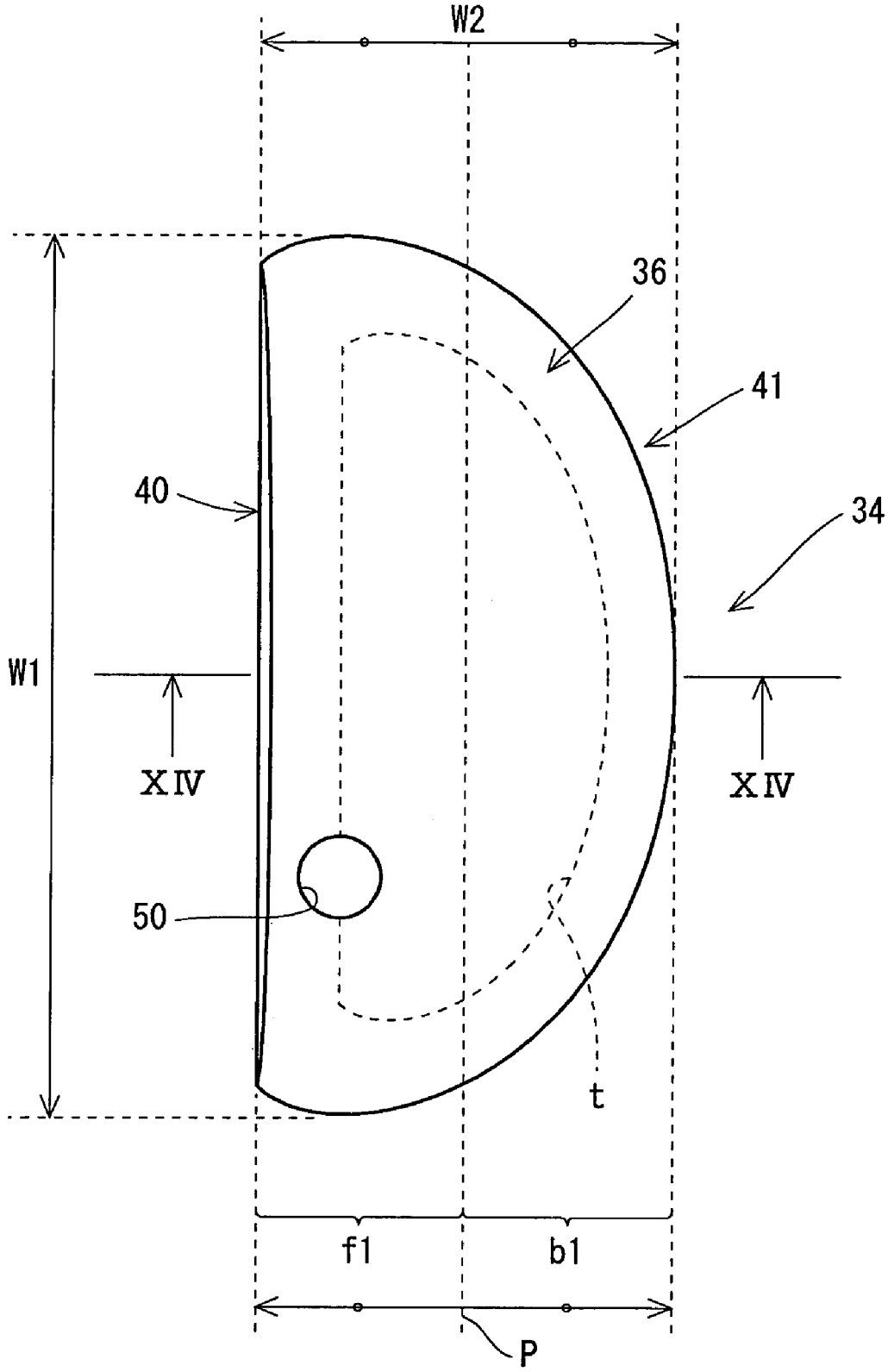
FIG. 9 shows a drawing of a putter head according to Example 3 viewed from the top surface side.
Figure 10:
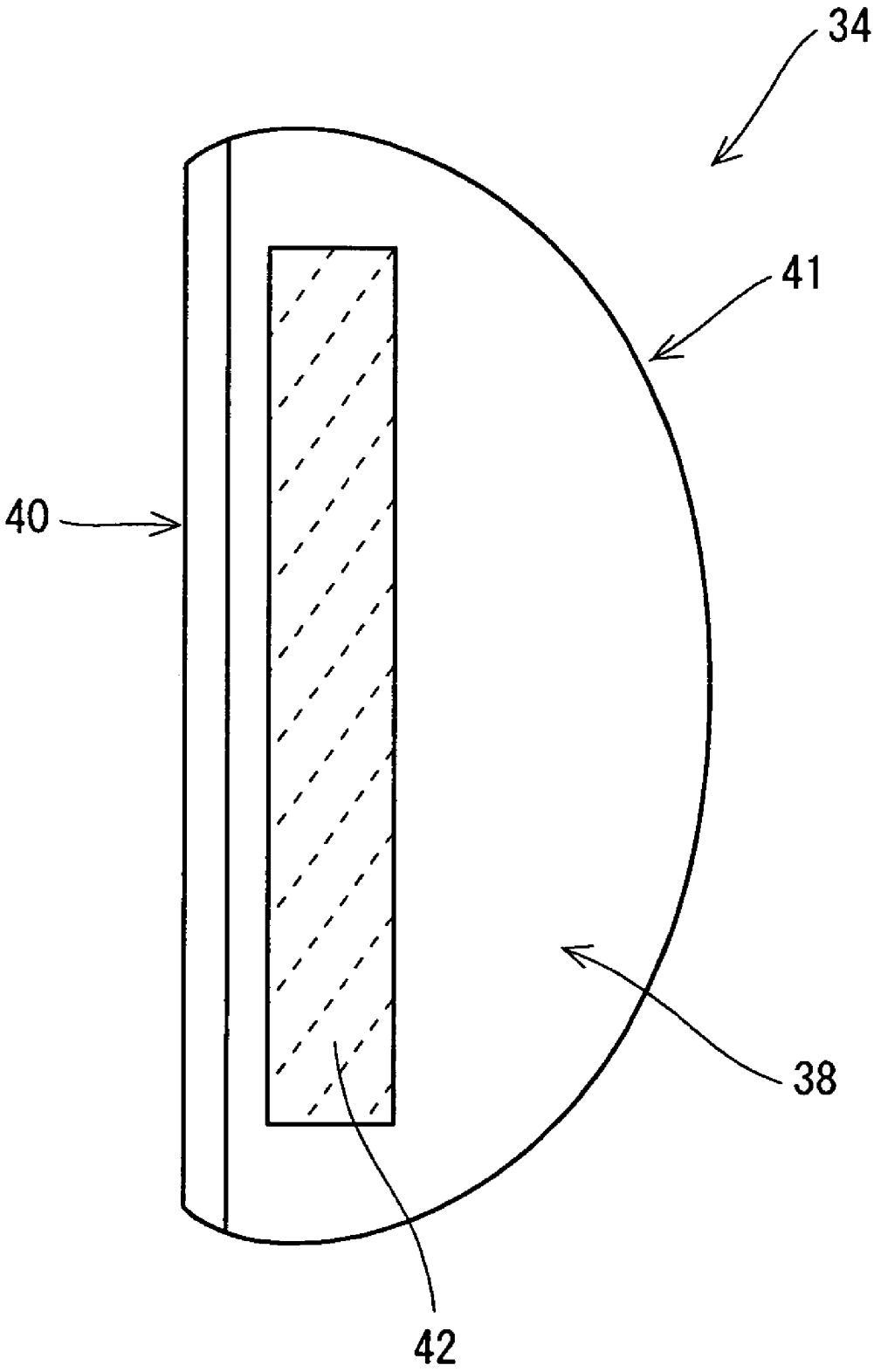
FIG. 10 shows a drawing of the putter head according to Example 3 viewed from the sole surface side.
Figure 11:
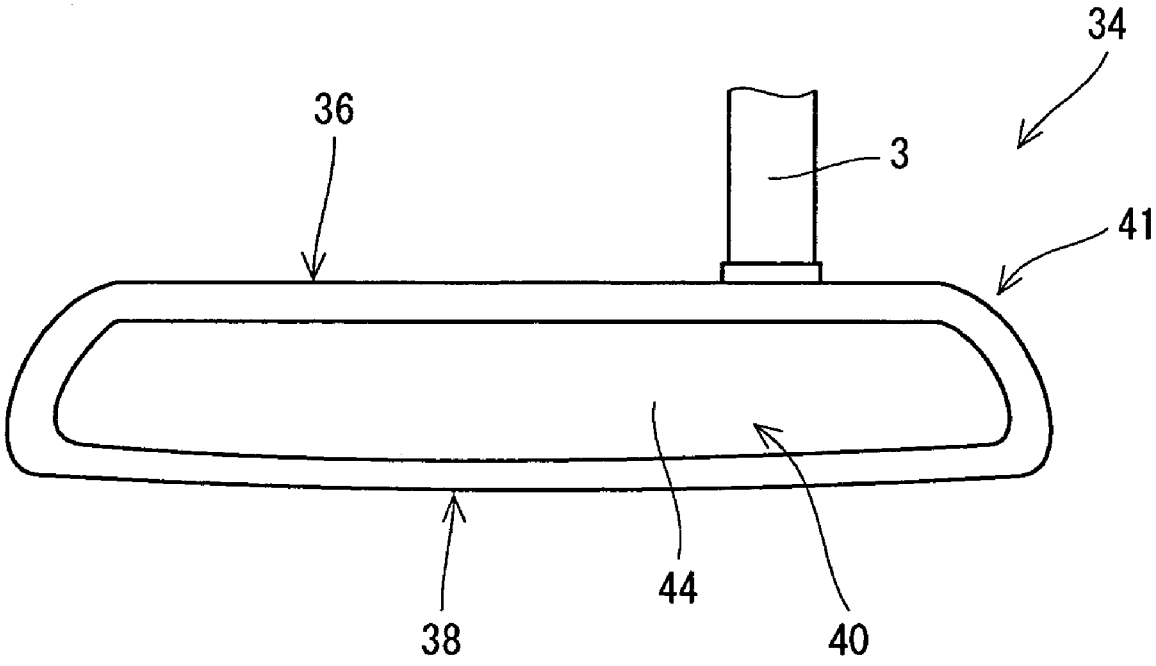
FIG. 11 shows a drawing of the putter head according to Example 3 viewed from the face surface side.
Figure 12:
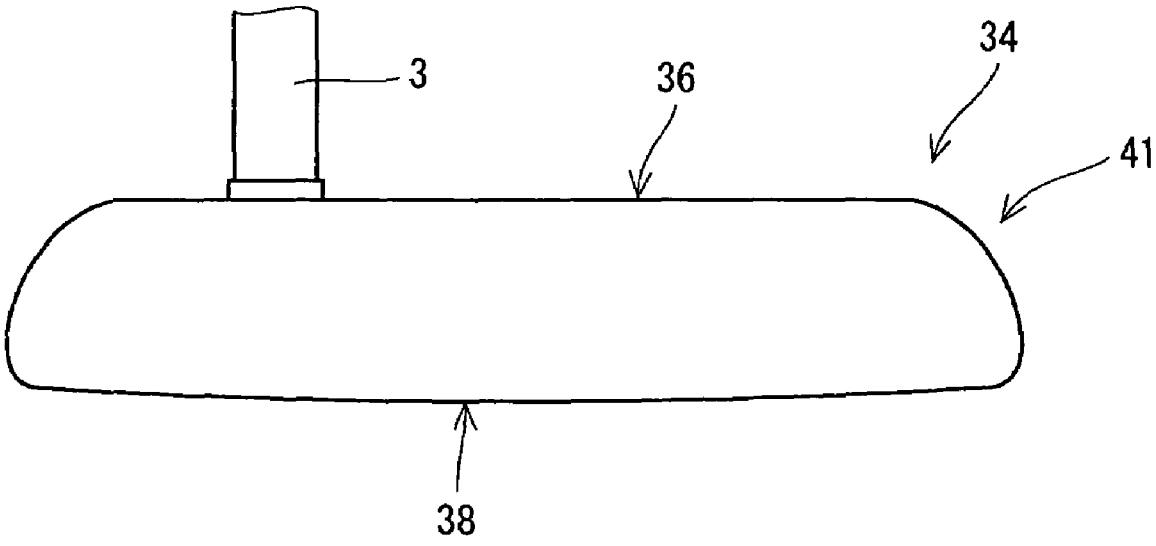
FIG. 12 shows a drawing of the putter head according to Example 3 viewed from the back side.
Figure 13:
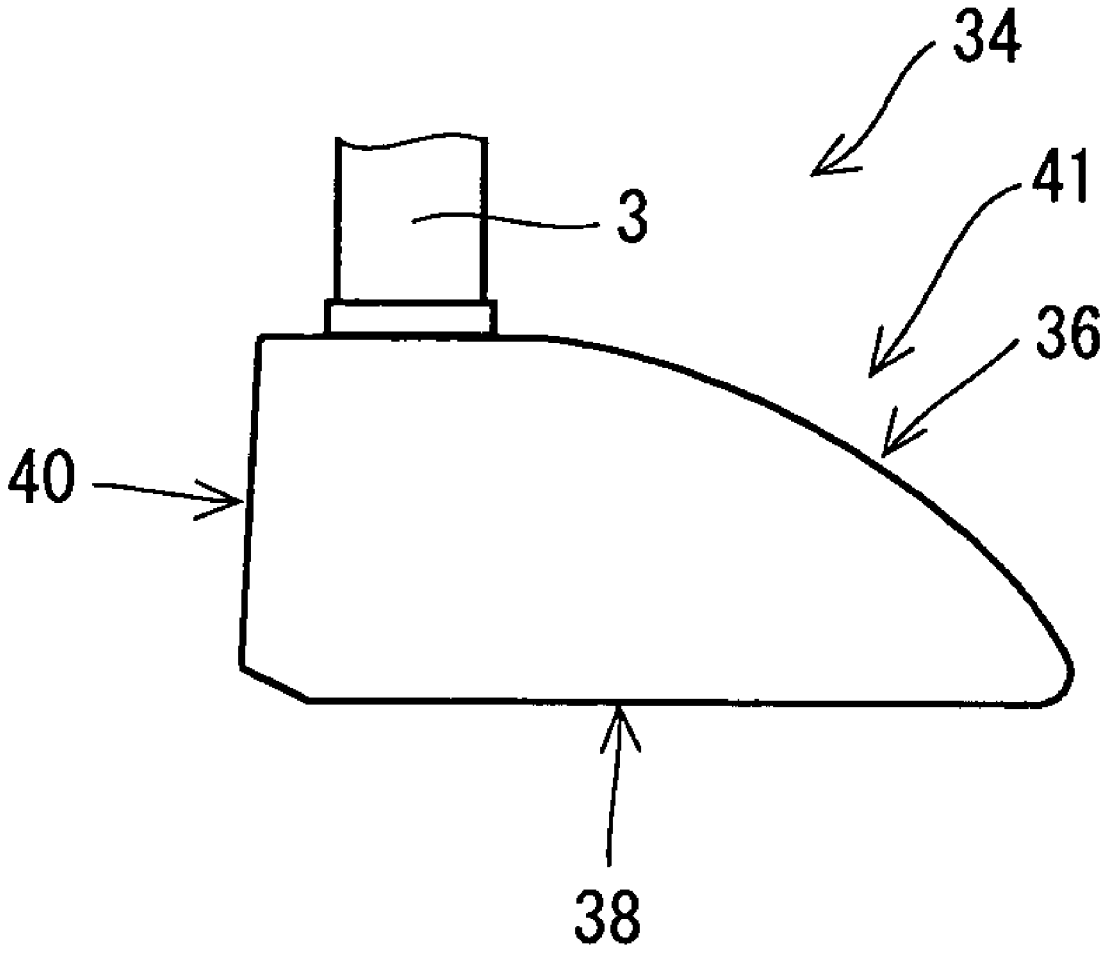
FIG. 13 shows a drawing of the putter head according to Example 3 viewed from the heel side.
Figure 14:
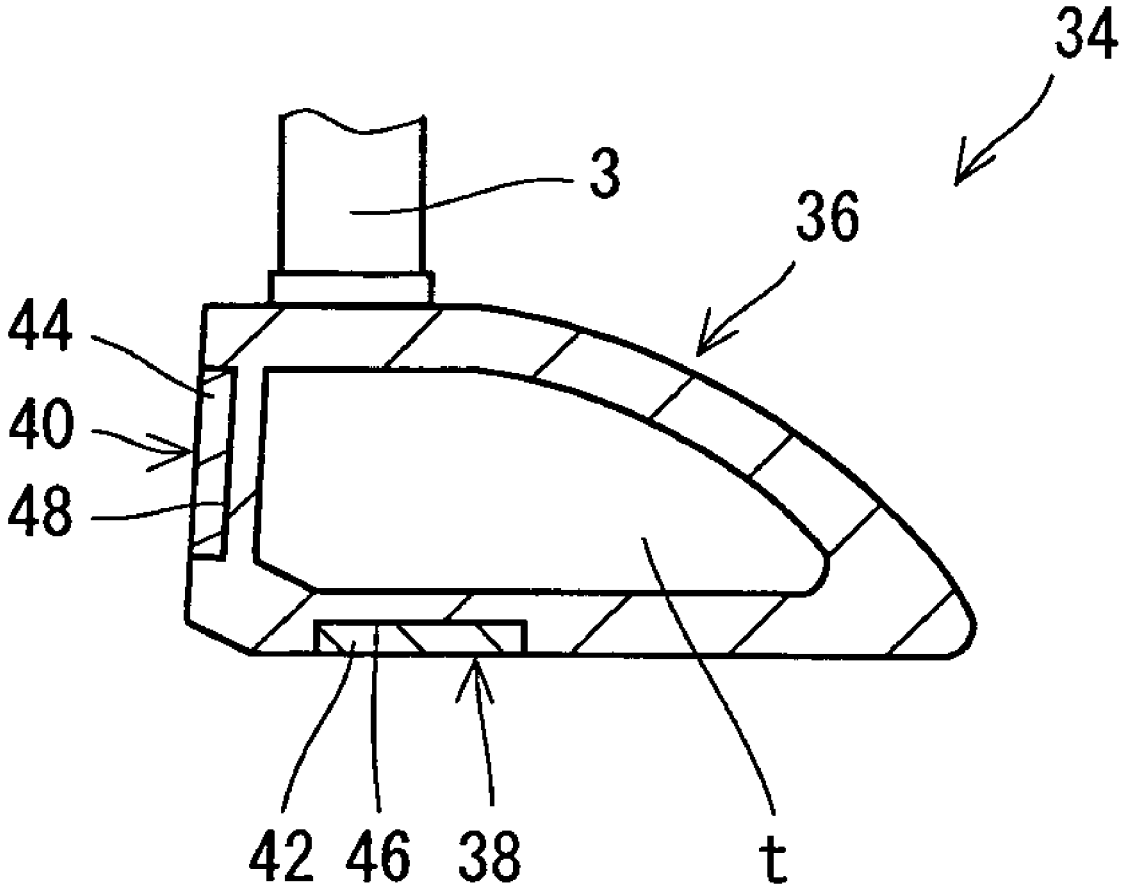
FIG. 14 shows a cross-sectional view taken along the line XIV-XIV of FIG. 9.

A putter head 34 according to Example 3 is shown in FIG. 9 to FIG. 14. FIG. 9 shows a drawing of the putter head 34 viewed from the top surface 36 side. FIG. 10 shows a drawing of the putter head 34 viewed from sole surface 38 side. FIG. 11 shows a drawing of the putter head 34 viewed from the face surface 40 side. FIG. 12 shows a drawing of the putter head 34 viewed from the back side. FIG. 13 shows a drawing of the putter head 34 viewed from the heel side. FIG. 14 shows a cross-sectional view taken along the line XIV-XIV of FIG. 9.

The putter head 34 has a head main body 41, a member having low specific gravity 42, and a face member 44. The head main body 41 has a hollow part t. What is indicated by the broken line in FIG. 9 is a contour line of the hollow part t. The head main body 41 has a sole recessed part 46, and a face recessed part 48. The depth and the shape of the sole recessed part 46 meet the member having low specific gravity 42. The depth and the shape of the face recessed part 48 meet the face member 44. Material, method of the manufacture and method of fixation of the head main body 41, the member having low specific gravity 42 and the face member 44 are similar to those in Example 1. As shown in FIG. 9, the contour shape of the back side of the putter head 34 is substantially a circular arc. The putter head 34 is a mallet type putter head, generally referred to. Also, the head main body 41 has a shaft hole 50. The member having low specific gravity 42 is shown by hatching with broken lines in FIG. 10.

In the putter head 34, the position of the center of gravity g2 of the member having low specific gravity 42 is located to get closer to the face side than the center of gravity g1 of the head does (not shown in the Figure). The putter head according to Example 3 was obtained in a similar manner to Example 1 except for the foregoing points.

Example 4

Figure 15:
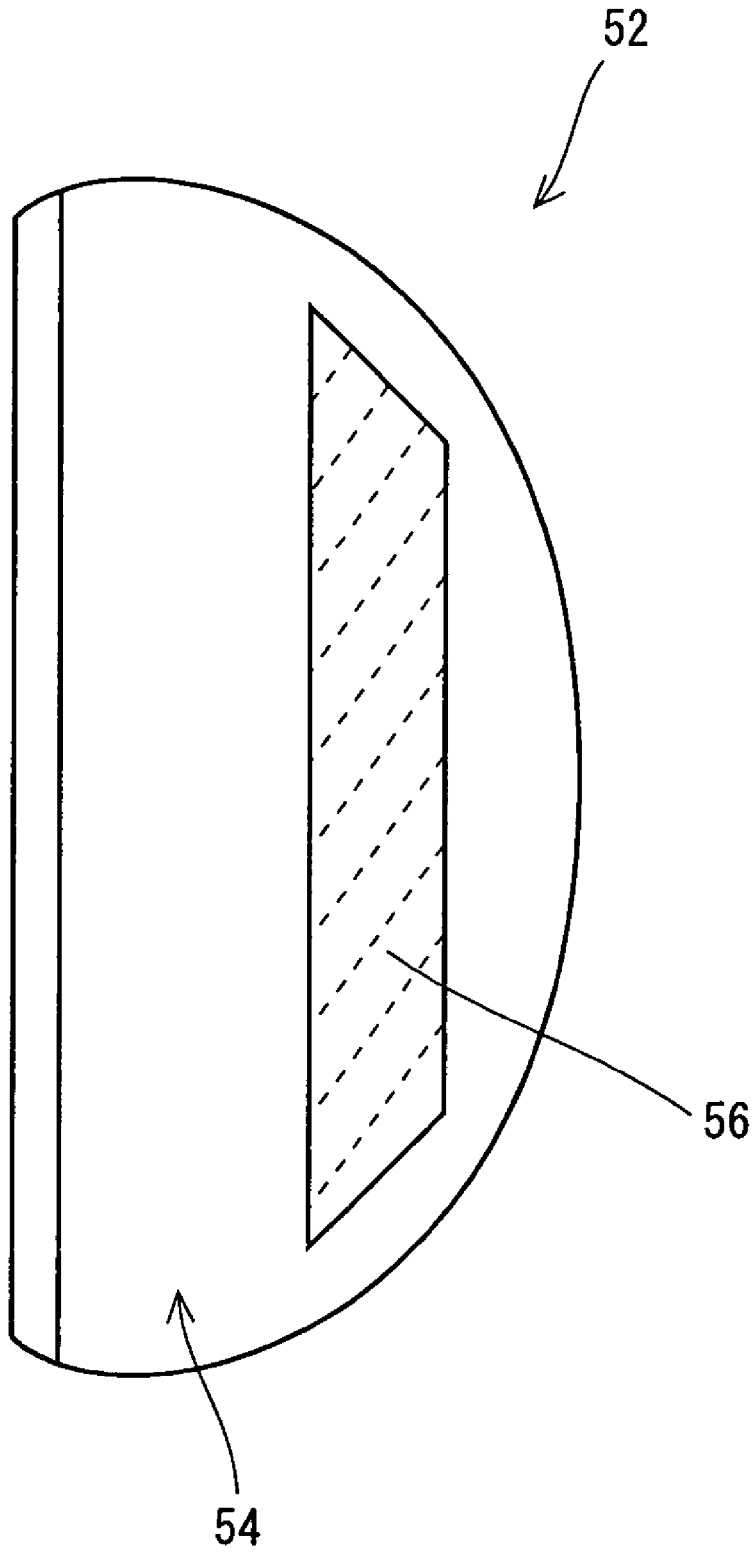
FIG. 15 shows a drawing of a putter head according to Example 4 viewed from the sole surface side.

FIG. 15 shows a drawing of a putter head 52 according to Example 4 viewed from sole surface 54 side. The putter head according to Example 4 was obtained in a similar manner to Example 3 except that the position and the shape of the member having low specific gravity 56 were altered as shown in FIG. 15, and the position and the shape of the sole recessed part (not shown in the Figure) were altered to meet therewith.

Comparative Example 1

Figure 16:
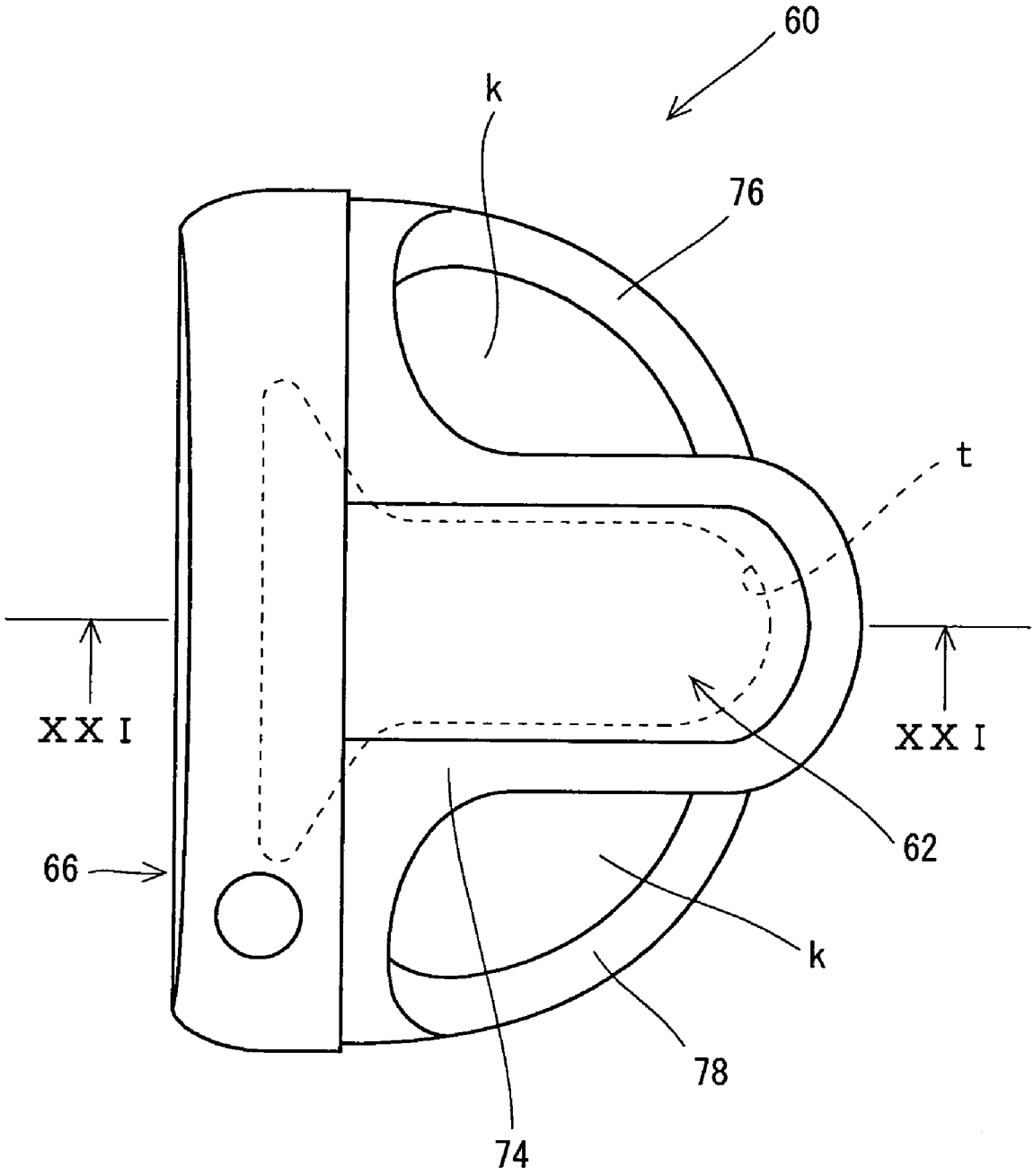
FIG. 16 shows a drawing of a putter head according to Comparative Example 1 viewed from the top surface side.
Figure 17:
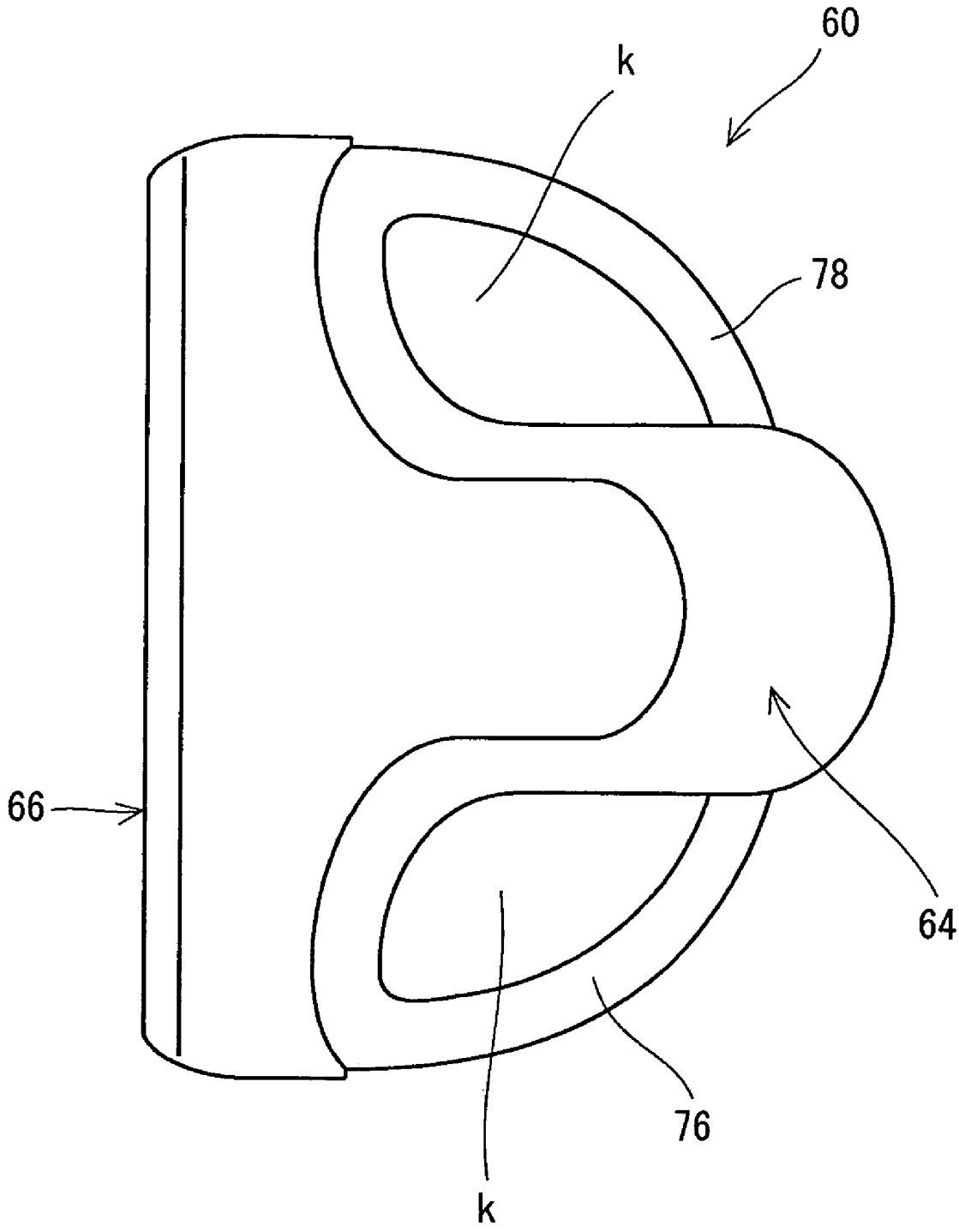
FIG. 17 shows a drawing of the putter head according to Comparative Example 1 viewed from the sole surface side.
Figure 18:
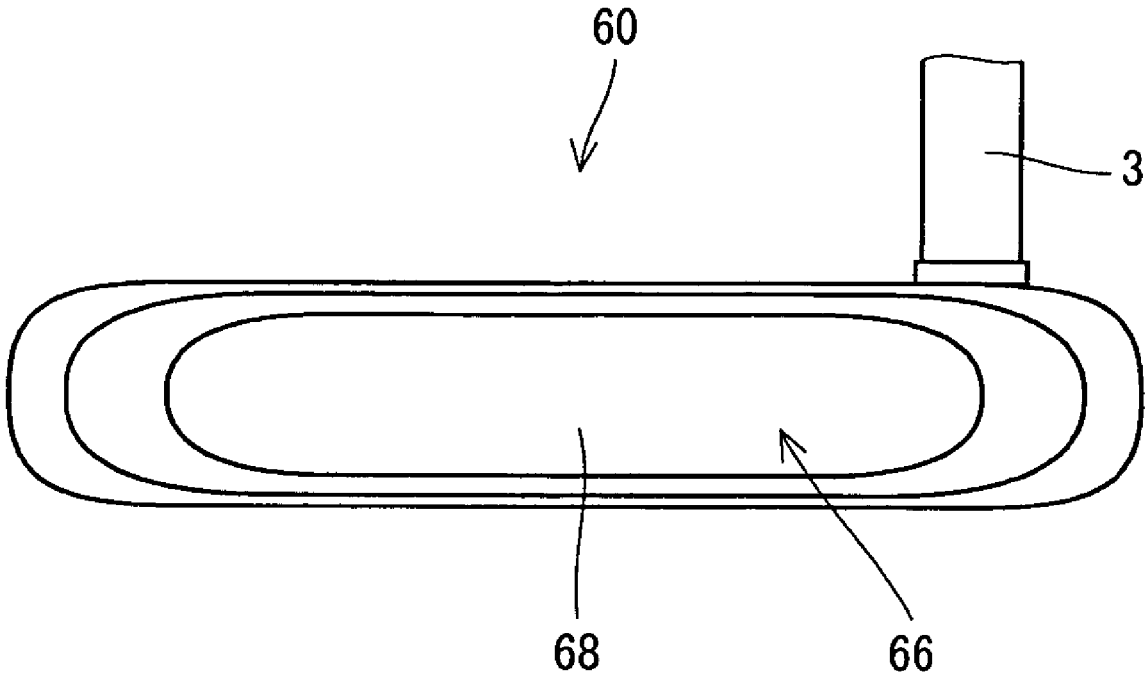
FIG. 18 shows a drawing of the putter head according to Comparative Example 1 viewed from the face surface side.
Figure 19:
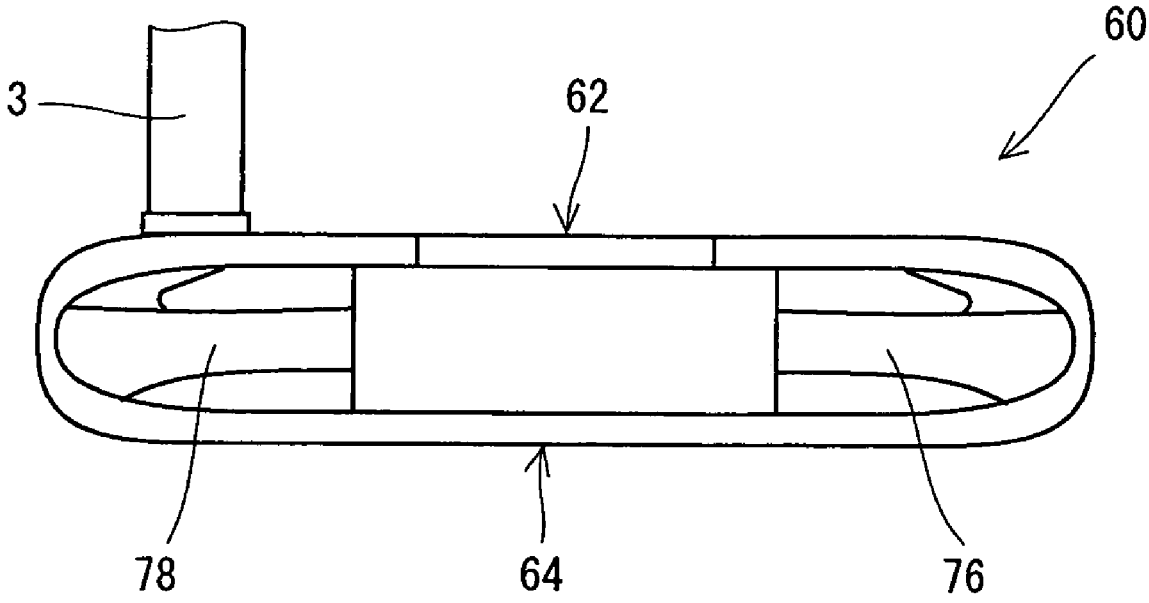
FIG. 19 shows a drawing of the putter head according to Comparative Example 1 viewed from the back side.
Figure 20:
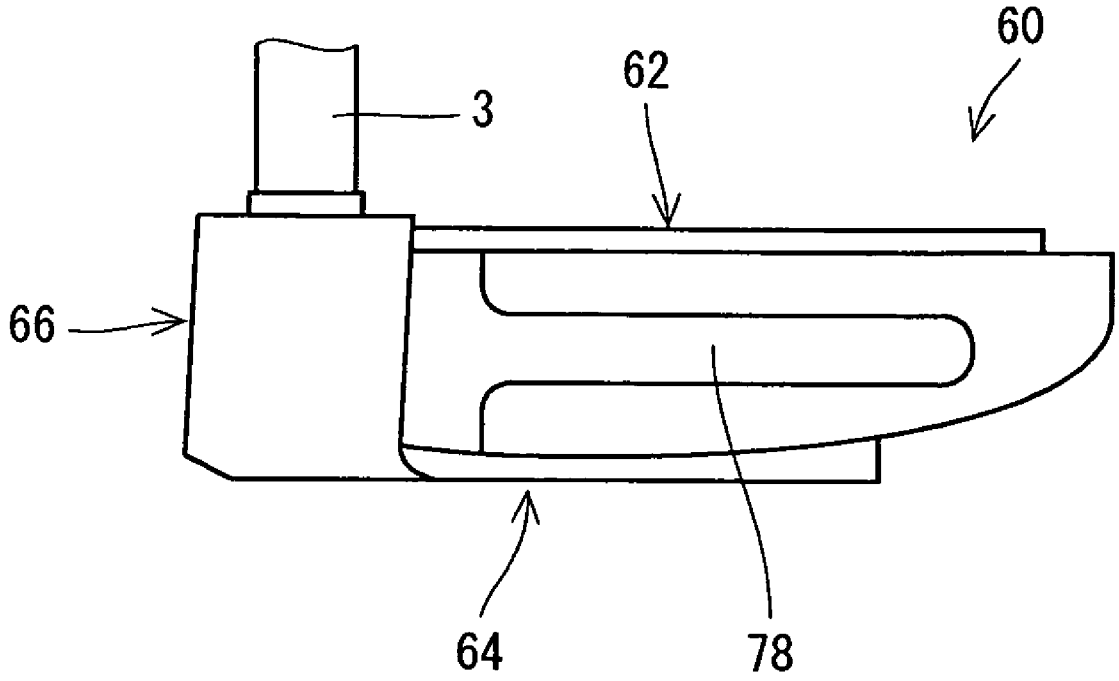
FIG. 20 shows a drawing of the putter head according to Comparative Example 1 viewed from the heel side.
Figure 21:
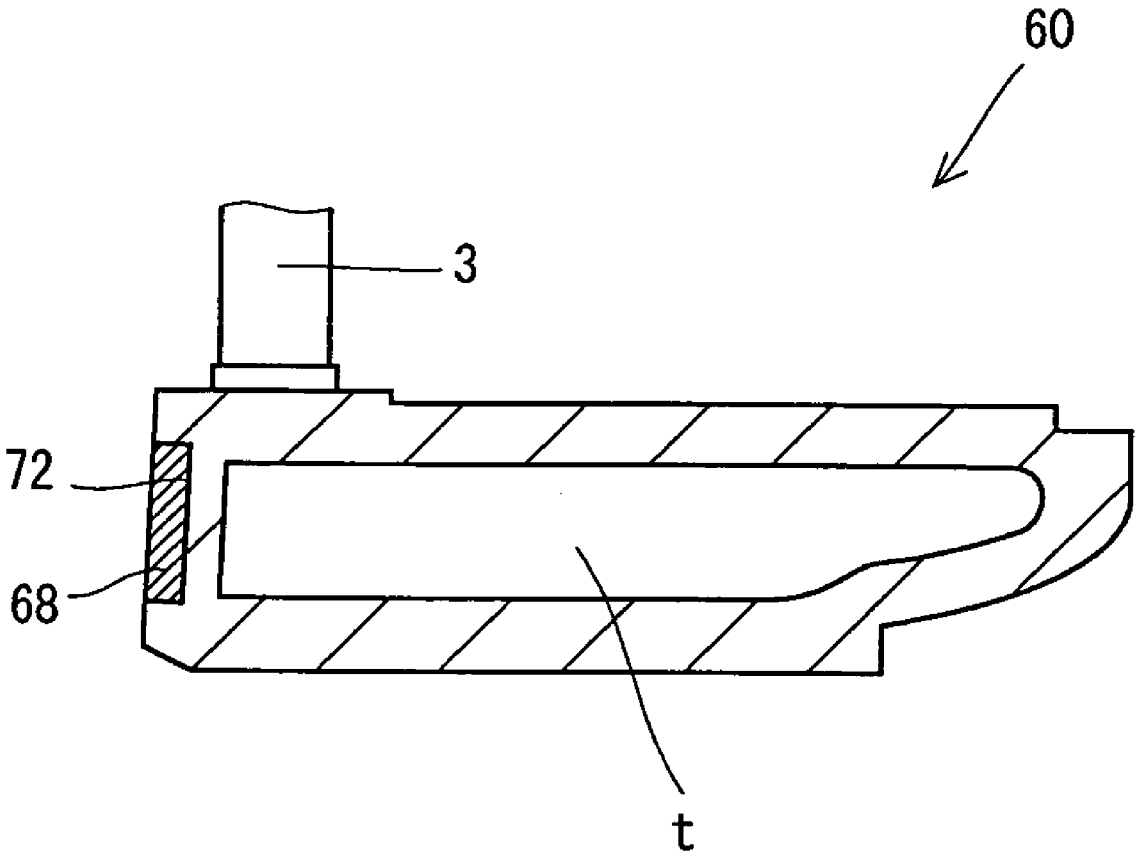
FIG. 21 shows a cross-sectional view taken along the line XXI-XXI of FIG. 16.

FIG. 16 to FIG. 21 show a drawing illustrating a putter head 60 according to Comparative Example 1. FIG. 16 shows a drawing of the putter head 60 viewed from the top surface 62 side. FIG. 17 shows a drawing of the putter head 60 viewed from sole surface 64 side. FIG. 18 shows a drawing of the putter head 60 viewed from the face surface 66 side. FIG. 19 shows a drawing of the putter head 60 viewed from the back side. FIG. 20 shows a drawing of the putter head 60 viewed from the heel side. FIG. 21 shows a cross-sectional view taken along the line XXI-XXI of FIG. 16.

The putter head 60 has a face member 68, and a head main body 70. The head main body 70 has a face recessed part 72 (see, FIG. 21). The shape and the depth of the face recessed part 78 meet the face member 68. Material and method of the manufacture of the head main body 70, and material, method of the manufacture and method of fixation of the face member 68 are similar to those in Example 1.

The head main body 70 has the hollow part t. What is indicated by the broken line in FIG. 16 is a contour line of the hollow part t. The head main body 70 has a principal part 74 forming a substantially T-shape viewed from the top surface 62 side, a toe side-joining part 76 extending between the toe side end and the back side end of the principal part 74, and a heel side-joining part 78 extending between the heel side end and the back side end of the principal part 74. The toe side-joining part 76 and the heel side-joining part 78 are extended in a substantially circular arc shape. There exists a space k between the toe side-joining part 76 and the principal part 74 (see, FIG. 16). The space k is also present between the heel side-joining part 78 and the principal part 74.

The putter head 60 does not have the member having low specific gravity.

A putter club according to Comparative Example 1 was obtained in a similar manner to Example 1 except for the points described in the foregoing.

Comparative Example 2

Figure 22:
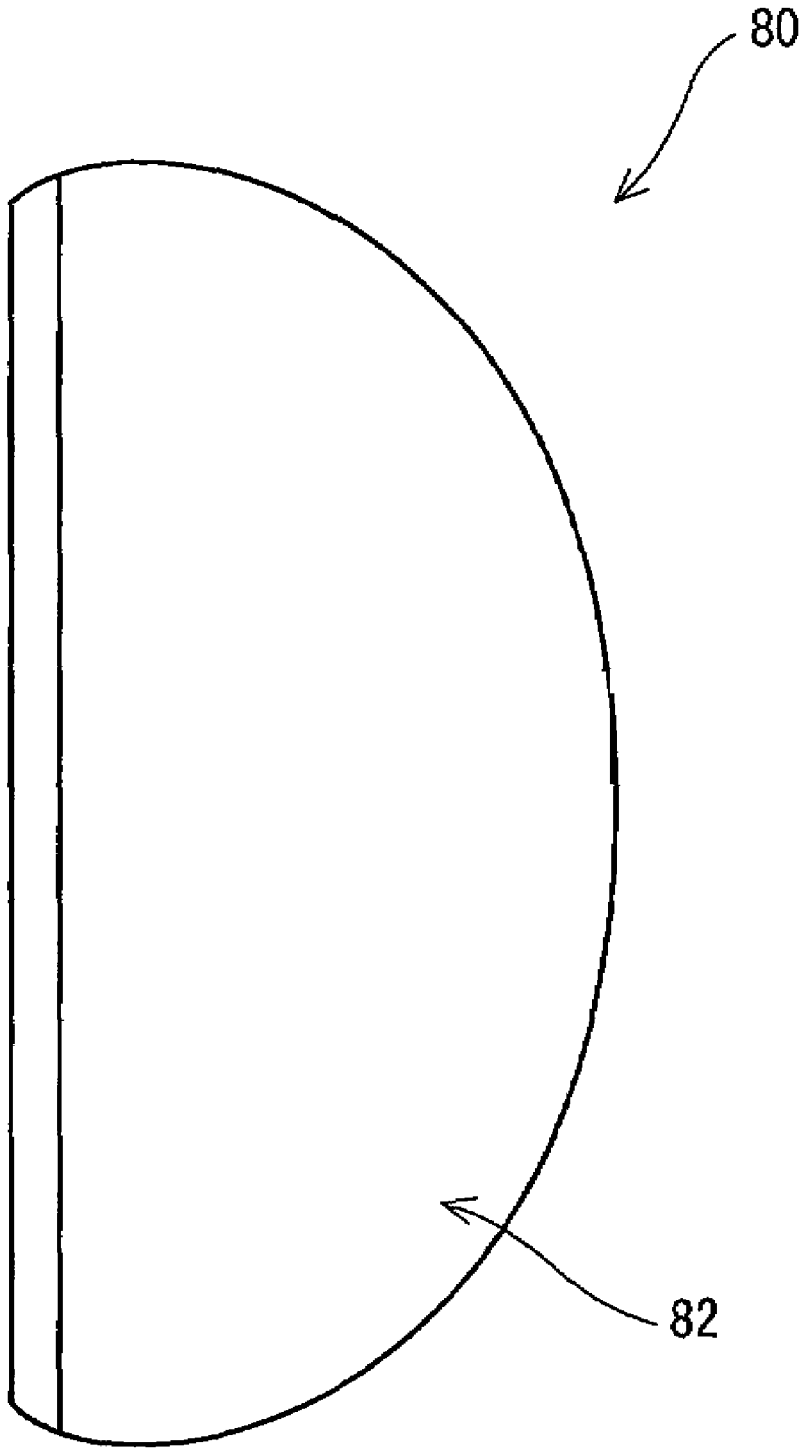
FIG. 22 shows a drawing of a putter head according to Comparative Example 2 viewed from the sole surface side.

FIG. 22 shows a drawing of a putter head 80 according to Comparative Example 2 viewed from sole surface 82 side. The shape of this putter head 80 is a miniature having a figure that is substantially similar to the putter head 34 according to Example 3 and the putter head 52 according to Example 4 as described above. This Comparative Example 2 does not include the member having low specific gravity. A putter club according to Comparative Example 2 was obtained in a similar manner to Example 3 except for the points of: not having the member having low specific gravity 42; the part corresponding to the member having low specific gravity 42 being occupied by the head main body; and the size of the head being reduced.

Specifications and results of evaluation of Examples 1 to 4, and Comparative Examples 1 and 2 are shown in the following Table 1.

TABLE1

Specifications and Results of Evaluation of Examples and Comparative Examples

| | Example 1 | Example 2 | Example 3 | Example 4 | Comparative Example 1 | Comparative Example 2 |
|---|---|---|---|---|---|---|
| Material of head main body | SUS630 | SUS630 | SUS630 | SUS630 | SUS630 | SUS630 |
| Specific gravity S1 of head main body | 7.8 | 7.8 | 7.8 | 7.8 | 7.8 | 7.8 |
| Material of member having low specific gravity | CFRP | CFRP | CFRP | CFRP | — | — |
| Specific gravity S2 of member having low specific gravity | 1.6 | 1.6 | 1.6 | 1.6 | — | — |
| S1/S2 | 4.875 | 4.875 | 4.875 | 4.875 | — | — |
| Loft angle at impact (°) | 4.0 | 4.0 | 4.0 | 4.0 | 4.0 | 4.0 |
| Total head weight (g) | 350 | 350 | 350 | 350 | 350 | 350 |
| Left-to-right moment of inertia of head (g/cm$^2$) | 4745 | 4524 | 3365 | 3182 | 4457 | 2510 |
| Sweet spot height h (mm) | 14.5 | 14.1 | 14.2 | 13.6 | 11.4 | 11.6 |
| Depth F of center of gravity (mm) | 27.0 | 21.3 | 22.3 | 16.5 | 24.5 | 18.2 |
| Distance FD in face-to-back direction between center of gravity g1 of head and center of gravity g2 of member having low specific gravity (mm) | 22.0 | 15.0 | 12.0 | 8.0 | — | — |
| Maximum width W1 in toe-to-heel direction (mm) | 109.0 | 109.0 | 90.5 | 90.5 | 98.0 | 80.1 |
| Maximum width W2 in face-to-back direction (mm) | 82.5 | 82.5 | 47.0 | 47.0 | 75.3 | 41.6 |

TABLE1-continued

Specifications and Results of Evaluation of Examples and Comparative Examples

| | Example 1 | Example 2 | Example 3 | Example 4 | Comparative Example 1 | Comparative Example 2 |
|---|---|---|---|---|---|---|
| W1/W2 | 1.32 | 1.32 | 1.93 | 1.93 | 1.30 | 1.93 |
| Weight M1 of face side part (g) | 145 | 226 | 162 | 215 | 205 | 197 |
| Weight M2 of back side part (g) | 205 | 124 | 188 | 135 | 145 | 153 |
| M1/M2 | 0.71 | 1.82 | 0.86 | 1.59 | 1.41 | 1.29 |
| Position of center of gravity of member having low specific gravity | Closer to face than position of center of gravity of the head | Closer to back than position of center of gravity of the head | Closer to back than position of center of gravity of the head | Closer to back than position of center of gravity of the head | — | — |
| Rolling distance (cm) | 423.5 | 418.3 | 407.6 | 405.2 | 395.4 | 397.2 |
| Rolling shake (cm) | 5.2 | 7.8 | 10.2 | 13.3 | 7.3 | 15.5 |

Methods of evaluation are as described below.

Rolling Distance

A ball on the green was hit using a putting machine which enables swinging of the putter like a pendulum, and the rolling distance was determined. The balls were commercially available two-piece balls. This putting machine can set the head speed accurately by setting the height of the uplifting. The head speed was set to be 2.5 (m/s). The loft angle at impact was set to be 4.0 degree. Each five balls were hit from the same position and toward the same direction on the green. Accordingly, the mean value was determined as the evaluation value. This evaluation value is shown in the above Table 1 as the "Rolling distance".

Rolling Shake

Putting was performed by a golf player in an attempt to target a cup four meters away, and shake in the left-to-right direction was measured. Both the shakes in the right direction and the shakes in the left direction were determined as a plus value. The values of the shakes were accumulated, and the mean value of the shakes was calculated. Mean values of the data of 100 balls in total, which were hit by ten testers who hit 10 balls each, are shown in Table 1 above in terms of "Rolling shake".

As shown in Table 1, longer rolling distance could be achieved according to the method of the manufacture in Examples as compared with the method of the manufacture in Comparative Examples. Accordingly, advantages of the present invention are clearly indicated by these results of evaluation.

The description hereinabove is merely for an example, and various modifications can be made in the scope not to depart from the principles of the present invention.

What is claimed is:

1. A golf club head for a putter which comprises a head main body constructed with a metal, and a member having a low specific gravity constructed with a material having a specific gravity lower than that of the metal constructing the head main body, said member having a low specific gravity being provided on the sole surface side of the head main body, at least a part of the sole surface being constructed with the member having a low specific gravity, and the distance in the face-to back direction FD between the center of gravity of the head and the center of gravity of the member having a low specific gravity being equal to or greater than 10 mm.

2. The golf club head for a putter according to claim 1, wherein the distance in the face-to back direction FD between the center of gravity of the head and the center of gravity of the member having a low specific gravity is equal to or greater than 13 mm.

3. The golf club head for a putter according to claim 1, wherein the distance in the face-to back direction FD between the center of gravity of the head and the center of gravity of the member having a low specific gravity is equal to or greater than 16 mm.

4. A golf club head for a putter which comprises a head main body constructed with a metal, and a member having a low specific gravity constructed with a material having a specific gravity lower than that of the metal constructing the head main body, said member having a low specific gravity being provided on the sole surface side of the head main body, and at least a part of the sole surface being constructed with the member having a low specific gravity, wherein provided that a maximum width in the toe-to-heel direction of the head is width W1; and a maximum width in the face-to-back direction of the head is width W2, a ratio (W1/W2) of the width W1 to the width W2 is preferably 1.05 or greater and 1.50 or less, said width W1 is 80 mm or greater and 130 mm or less, and if the head is comparted into two parts including a face side part and a back side part by a plane that passes through the middle position of the width W2 and that is perpendicular to the face-to-back direction, a ratio (M1/M2) of the weight M1 of the face side part to the weight M2 of the back side part is 0.40 or greater and 1.30 or less.

5. A golf club head for a putter which comprises a head main body constructed with a metal, and a member having a low specific gravity constructed with a material having a specific gravity lower than that of the metal constructing the head main body, the golf club head does not have a hosel that protrudes upwardly from the head main body, said member having a low specific gravity being provided on the sole surface side of the head main body, at least a part of the sole surface being constructed with the member having a low specific gravity, and the ratio (Sp/St) of the surface area Sp of the member having low specific gravity to total area St of the sole surface of the head being equal to or greater than 0.10 and equal to or less than 0.5.

6. The golf club head for a putter according to claim 5, wherein the ratio (Sp/St) of the surface area Sp of the member having a low specific gravity to a total area St of the sole surface of the head is equal to or greater than 0.15.

* * * * *